US008518623B2

(12) United States Patent
Kamikura et al.

(10) Patent No.: US 8,518,623 B2
(45) Date of Patent: Aug. 27, 2013

(54) TONER AND TONER PARTICLE PRODUCING METHOD

(75) Inventors: Kenta Kamikura, Mishima (JP); Shinya Yachi, Mishima (JP); Kazumi Yoshizaki, Suntou-gun (JP); Yasushi Katsuta, Susono (JP); Takeshi Kaburagi, Suntou-gun (JP)

(73) Assignee: Canon Kabushiki Kasiha, Tokyo (JP)

( * ) Notice: Subject to any disclaimer, the term of this patent is extended or adjusted under 35 U.S.C. 154(b) by 191 days.

(21) Appl. No.: 13/076,265

(22) Filed: Mar. 30, 2011

(65) Prior Publication Data

US 2011/0244386 A1 Oct. 6, 2011

(30) Foreign Application Priority Data

Mar. 31, 2010 (JP) ..... 2010-082819

(51) Int. Cl.
*G03G 9/08* (2006.01)

(52) U.S. Cl.
USPC ..... 430/109.3; 430/108.2; 430/108.4; 430/108.5; 430/137.14

(58) Field of Classification Search
USPC ..... 430/109.4, 110.2
See application file for complete search history.

(56) References Cited

U.S. PATENT DOCUMENTS

| | | | | |
|---|---|---|---|---|
| 5,866,291 | A | 2/1999 | Ikegami | |
| 2006/0063082 | A1 * | 3/2006 | Mikuriya et al. | 430/108.3 |
| 2007/0231729 | A1 * | 10/2007 | Ohno et al. | 430/108.24 |
| 2008/0096120 | A1 * | 4/2008 | Yamaguchi et al. | 430/110.2 |
| 2009/0117483 | A1 * | 5/2009 | Inaba et al. | 430/109.3 |
| 2009/0297975 | A1 * | 12/2009 | Ishikawa et al. | 430/109.4 |
| 2009/0305159 | A1 * | 12/2009 | Zhou et al. | 430/110.2 |
| 2010/0209838 | A1 * | 8/2010 | Kusahara et al. | 430/109.4 |
| 2011/0183249 | A1 * | 7/2011 | Sata et al. | 430/105 |

FOREIGN PATENT DOCUMENTS

| | | | |
|---|---|---|---|
| JP | 05-150549 | A | 6/1993 |
| JP | 10-090947 | A | 4/1998 |
| JP | 2000-112186 | A | 4/2000 |
| JP | 2008-064837 | A | 3/2008 |
| JP | 2008-268366 | A | 11/2008 |

* cited by examiner

*Primary Examiner* — Mark F Huff
*Assistant Examiner* — Rashid Alam
(74) *Attorney, Agent, or Firm* — Canon U.S.A., Inc., IP Division

(57) ABSTRACT

A toner includes a toner particle, which contains at least a binding resin, a colorant, and two types of polar resins, i.e., a polar resin H and a polar resin L, and which is obtained with granulation in a water-based medium, wherein solubility parameters, glass transition points, and weight-average molecular weights of the binding resin, the polar resin H, and the polar resin L, as well as amounts of the added resins satisfy respective specific relationships.

9 Claims, 2 Drawing Sheets

TONER AND TONER PARTICLE PRODUCING METHOD

BACKGROUND OF THE INVENTION

1. Field of the Invention

The present invention relates to a toner for use in recording processes, such as electrophotography, electrostatic recording, magnetic recording, and toner jetting. The present invention also relates to a toner particle producing method.

2. Description of the Related Art

Recently, in laser printers and copying machines utilizing electrophotography, a process speed has been increased at a fast pace, and a toner superior in development performance, transferability, and low-temperature fixation ability has been demanded. In particular, because the low-temperature fixation ability contributes to saving of power consumption, it is regarded as an essential factor in recent research and development of toners of the type that is strongly required to be adapted for environment countermeasures.

Meanwhile, with increasing market expansion of laser printers and copying machines, toners have been demanded to exhibit satisfactory performance even in storage and use under high-temperature and high-humidity environments. Further, the temperature in an apparatus tends to rise due to fanless design in a body of the apparatus with the view of realizing more downsizing and quieting of the apparatus. For that reason, toners have been required to have higher heat resistance as well.

To achieve improvements in development performance, transferability, low-temperature fixation ability, and heat resistance all together, a toner having the so-called core shell structure has been studied in the past. That type toner is designed such that a surface layer of a toner particle has heat resistance and durability, and that an inner layer of the toner particle has the low-temperature fixation ability.

For providing a toner that can realize an image with a high glossiness even in low-temperature fixing and that has high durability even under severe use conditions, Japanese Patent Laid-Open No. 2008-268366 discloses the toner in which a vinyl-based polar resin having a certain acid value and having low molecular weight is interposed between a core and a shell. Japanese Patent Laid-Open No. 5-150549 discloses a method of producing a suspension-polymerized toner, which includes a step of, when the toner is produced by a suspension polymerization method, adding a resin that has an SP (Solubility Parameter) value of 9.0 to 15.0 $((cal/cm^3)^{1/2})$ and has a higher glass transition point than a binding resin. Japanese Patent Laid-Open No. 2008-064837 discloses a toner of the core shell structure having a core covered with one ore more shells, in which one of shell layers contains wax and the difference between an SP value of a resin exhibiting a maximum SP value among resins, which form the shell layers, and an SP value of a binding resin is 0.20 to 0.70 $((cal/cm^3)^{1/2})$ or less.

SUMMARY OF THE INVENTION

At present, however, toners are demanded to have a higher level of heat resistance, and the above-mentioned known techniques have a difficulty in obtaining the toners having the demanded level of heat resistance. It is further difficult to obtain a toner that satisfies higher development performance, higher transferability, and superior low-temperature fixation ability by mass while ensuring the demanded level of heat resistance. Aspects of the present invention are directed to providing a toner that can satisfy higher development performance, higher transferability, and superior low-temperature fixation ability by mass while ensuring satisfactory storage stability even under environments at higher temperatures and superior durability even in use at higher temperatures.

According to aspects of the present invention, there is provided a toner comprising a toner particle that comprises a binding resin, a colorant, a polar resin H, and a polar resin L, wherein the toner particle is obtained with granulation in a water-based medium, the polar resin H and the polar resin L are each a polar resin containing a carboxyl group and having an acid value of 3.0 (mgKOH/g) or more, wherein when an SP value of the binding resin is denoted by δB $((cal/cm^3)^{1/2})$, an SP value of the polar resin H is denoted by δH $((cal/cm^3)^{1/2})$, and an SP value of the polar resin L is denoted by δL $((cal/cm^3)^{1/2})$, the following formulas are satisfied;

$$8.70 \leqq \delta B \leqq 9.50$$

$$1.00 \leqq \delta H - \delta B \leqq 3.00$$

$$|\delta L - \delta B| \leqq 0.70,$$

wherein when a glass transition point of the polar resin H is denoted by TgH (° C.) and a glass transition point of the polar resin L is denoted by TgL (° C.), the following formulas are satisfied;

$$65.0 \leqq TgH \leqq 85.0$$

$$75.0 \leqq TgL \leqq 105.0$$

$$TgH < TgL,$$

wherein when a weight-average molecular weight of the polar resin H is denoted by MwH and a weight-average molecular weight of the polar resin L is denoted by MwL, MwH is $5.0\times10^3$ or more and $1.5\times10^4$ or less, and MwL is $1.0\times10^4$ or more and $3.0\times10^4$ or less, and wherein a content of the polar resin H with respect to 100.0 parts by mass of the binding resin is 1.0 part by mass or more and 10.0 parts by mass or less, and a content of the polar resin L with respect to 100.0 parts by mass of the binding resin is 5.0 parts by mass or more and 25.0 parts by mass or less.

Further, according to aspects of the present invention, there is provided a toner particle producing method for producing the toner particle used in the toner.

With aspects of the present invention, the toner capable of satisfying higher development performance, higher transferability, and superior low-temperature fixation ability by mass while ensuring satisfactory storage stability even under environments at higher temperatures and superior durability even in use at higher temperatures can be obtained.

Further features of the present invention will become apparent from the following description of exemplary embodiments with reference to the attached drawings.

DESCRIPTION OF THE EMBODIMENTS

Figure 1A:
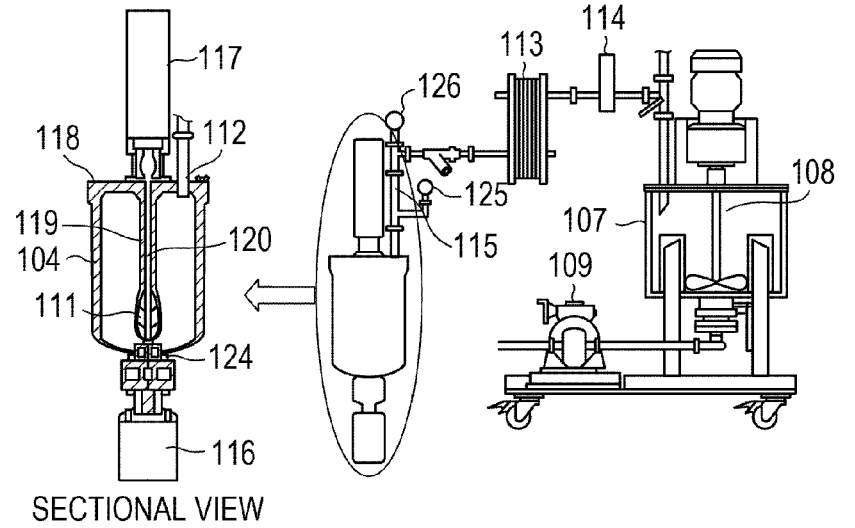
FIGS. 1A to 1C are explanatory views of a stirring apparatus having stirring blades.

For the purpose of increasing heat resistance of toners while maintaining the low-temperature fixation ability thereof, studies for forming the structure of a toner particle as the so-called core shell structure has hitherto been conducted by employing a resin having a higher glass transition point (also abbreviated to "Tg" hereinafter) in a surface layer of the toner particle, and by employing a resin having a lower Tg in an inner layer of the toner particle. In the core shell structure, a compatible (phase-mixed) state of the inner layer and the surface layer of the toner particle is divided into two types depending on properties of the resins used, etc. In one type, the inner layer and the surface layer of the toner particle are in a phase-separated state such that the inner layer and the surface layer of the toner particle are clearly divided from each other. In the other type, the inner layer and the surface layer of the toner particle are fairly compatible with each other such that there is no clear boundary between the inner layer and the surface layer of the toner particle. The compatible state between the inner layer and the surface layer of the toner particle can be controlled by adjusting the difference in solubility parameter (also referred to as an "SP value") between the resin used for the surface layer of the toner particle and the inner layer of the toner particle. A technique of employing, as an index for determining compatibility between two components, the difference in solubility parameter between the two components is known to those skilled in the art (see, e.g., Japanese Patent Laid-Open No. 10-090947 and Japanese Patent Laid-Open No. 2000-112186).

As the difference in SP value between the resin used for the surface layer of the toner particle and the resin used for the inner layer of the toner particle increases, those two resins are more apt to separate in phase from each other. In such a core shell structure, it is thought that a clear interface exists between the inner layer and the surface layer of the toner particle. Therefore, the resin having the lower Tg and forming the inner layer of the toner particle is less apt to affect the surface layer of the toner particle and is more apt to exhibit satisfactory storage stability at high temperatures. However, because the inner layer of the toner particle and the surface layer of the toner particle greatly differ in Tg from each other, the difference in coefficient of thermal expansion between the inner layer and the surface layer of the toner particle tends to increase when the toner is heated to temperature beyond Tg of the inner layer of the toner particle. As a result, the surface layer of the toner particle may peel off or crack in some cases, thus causing a reduction of toner durability in use at high temperatures. Once peeling-off, cracking, etc. of the surface layer of the toner particle occur, the storage stability of the toner is also reduced.

On the other hand, as the difference in SP value between the resin used for the surface layer of the toner particle and the resin used for the inner layer of the toner particle decreases, those two resins are more apt to compatibly mix with each other. In such a core shell structure, it is thought that a clear interface does not exist between the inner layer and the surface layer of the toner particle. Therefore, even when the toner is heated to temperature beyond Tg of the resin, strains occurred at the interface between the inner layer and the surface layer are held small, and the dynamical strength at the interface between the inner layer and the surface layer is held high. As a result, it is believed that the toner of this type exhibits a smaller reduction of durability in storage and use at high temperatures. However, because the inner layer and the surface layer of the toner particle are continuously present, a shielding ability of the surface layer of the toner particle against the inner layer of the toner particle is low and the storage stability is harder to increase even when Tg of the binding resin is sufficiently high. Thus, a blocking phenomenon or the like is more apt to occur.

The toner according to the embodiment of the present invention can satisfy higher development performance, higher transferability, and superior low-temperature fixation ability all together while ensuring satisfactory storage stability even under environments at higher temperatures by setting solubility parameters, glass transition points, molecular weights, and contents of the polar resins, which are contained in the toner particle, to be held within respective certain ranges, by specifying the relationships in solubility parameter between the polar resins and the binding resin, and by granulating the toner particle in the water-based medium. The toner according to the embodiment of the present invention will be described in detail below.

A polar resin H and a polar resin L each containing a carboxyl group and having an acid value of 3.0 (mgKOH/g) or more are used in the toner according to the embodiment of the present invention. Further, an SP value (δB) of the binding resin and an SP value (δH) of the polar resin H satisfy the relationship of $1.00 \leqq \delta H - \delta B \leqq 3.00$, and δB and an SP value (δL) of the polar resin L satisfy the relationship of $|\delta L - \delta B| \leqq 0.70$. When the toner particle is produced through granulation in the water-based medium by using the above-mentioned materials, it is believed that the toner particle has a three-layer structure including an inner layer made of the binding resin, an intermediate layer in which the binding resin and the polar resin L are compatibly mixed with each other, and a surface layer made of the polar resin H, looking from the innermost side of the toner particle, based on the sequence of the SP values and the acid values of the polar resins.

Let now consider profiles of physical values of toner particle layers from the inner layer to the surface layer of the toner particle that is contained in the toner according to the embodiment of the present invention. Considering first the SP values of the resins, the difference in SP value between the binding resin forming the inner layer and the polar resin L forming the intermediate layer is small, while the difference in SP value between the polar resin H forming the surface layer and the polar resin L forming the intermediate layer is large. It is, therefore, believed that a clear interface does not exist between the inner layer and the intermediate layer, and that a clear interface exists between the intermediate layer and the surface layer. Considering a Tg profile in the toner particle having the above-mentioned structure, Tg of the intermediate layer in its portion near the inner layer is close to Tg of the binding resin because the binding resin and the polar resin L are compatibly mixed with each other. On the other hand, Tg of the intermediate layer in its portion near the surface layer is greatly affected by Tg of the polar resin L. However, because the content of the polar resin L is smaller than that of the binding resin, it is believed that Tg near the interface between the intermediate layer and the surface layer is between Tg of the polar resin L and Tg of the binding resin. Thus, Tg has such a profile that, in the inner layer of the toner particle, it is substantially equal to Tg of the binding resin. In the intermediate layer of the toner particle, Tg is close to Tg of the binding resin in a portion near the inner layer and it approaches Tg of the polar resin L in a portion near the surface layer of the toner particle. Further, in the surface layer of the toner particle, Tg is substantially equal to Tg of the polar resin H.

With the structure described above, the toner according to the embodiment of the present invention can overcome the respective problems caused by the phase-separated type core shell structure and the phase-mixed type core shell structure. More specifically, in the toner according to the embodiment of the present invention, even when the toner is heated to temperature beyond Tg of the binding resin, strains occurred at the interface between the intermediate layer and the surface layer of the toner particle are held small, and the dynamical strength at the interface between the intermediate layer and the surface layer is held high. As a result, the toner according to the embodiment of the present invention exhibits a smaller reduction of the durability in storage and use at high temperatures. Further, because the interface providing the large difference in SP value is present between the intermediate layer and the surface layer of the toner particle, the shielding ability of the surface layer of the toner particle against the inner layer of the toner particle can be increased. In addition, with the structure described above, durability comparable to that of the known toner can be maintained even when designing the toner particle such that Tg of each of the polar resin H and the polar resin L is set to a lower value, or that the molecular weight of each of the polar resin H and the polar resin L is set to a lower value, or that the content of each of the polar resin H and the polar resin L is set to a lower value. Hence, the toner according to the embodiment of the present invention can realize durability and low-temperature fixation ability at higher levels than those of the known toner.

In the toner according to the embodiment of the present invention, the SP value δB ($(cal/cm^3)^{1/2}$) of the binding resin is 8.70 or more and 9.50 or less, such as 8.90 or more and 9.30 or less, and even 9.00 or more and 9.20 or less. By setting δB to fall within the range mentioned above first, the toner particle made up of the inner layer, the intermediate layer, and the inner layer can be obtained. δB is a factor greatly affecting improvements of the durability and the storage stability of the toner in storage and use at high temperatures. δB may be 8.90 or more and 9.30 or less, such as 9.00 or more and 9.20 or less. If δB is less than 8.70, hydrophillicity of the entire toner becomes too low, thus resulting in, for example, that particles are brought into an unstable state during the granulation in the water-based medium and a proper particle-size distribution cannot be obtained. If δB is more than 9.50, hydrophillicity of the entire toner is too high, thus resulting in, for example, that particles having smaller sizes tend to be generated during the granulation in the water-based medium and dependency of chargeability upon humidity is increased.

In the toner according to the embodiment of the present invention, the difference (δH−δB) ($(cal/cm^3)^{1/2}$) between the SP value δH ($(cal/cm^3)^{1/2}$) of the polar resin H and the SP value δB ($(cal/cm^3)^{1/2}$) of the binding resin is 1.00 or more and 3.00 or less, such as 1.30 or more and 2.50 or less, and even 1.30 or more and 2.00 or less. When (δH−δB) is within the range mentioned above first, this condition contributes to forming the interface between the surface layer and the intermediate surface of the toner particle and is effective in increasing the storage stability in storage at high temperatures. The difference (δH−δB) may be 1.30 or more and 2.50 or less such as 1.30 or more and 2.00 or less. If (δH−δB) is less than 1.00, the interface is not formed between the surface layer and the intermediate layer, and the inner layer is not effectively shielded by the surface layer, thus causing degradation of the storage stability in storage at high temperatures. If (δH−δB) exceeds 3.00, hydrophillicity of the polar resin H is too high, thus resulting in, for example, that particles having smaller sizes tend to be generated when the granulation is performed in the water-based medium.

In the toner according to the embodiment of the present invention, an absolute value |δL−δB| ($(cal/cm^3)^{1/2}$) of the difference between the SP value (δL) of the polar resin L and the SP value (δB) of the binding resin is 0.70 or less. The difference (δL−δB) may be −0.20 or more and 0.50 or less such as −0.20 or more and 0.30 or less. Because the polar resin L has the acid value of 3.0 or more, the intermediate layer can be formed even with δL being smaller than δB when the toner particle is granulated in the water-based medium. Accordingly, when |δL−δB| is 0.70 or less, this condition contributes to increasing adhesion between the inner layer and the intermediate surface of the toner particle, and is effective in increasing the durability of the toner in use at high temperatures. If |δL−δB| exceeds 0.70, compatibility between the inner layer and the intermediate layer is low and strains caused by heating at the interface between the inner layer and the intermediate surface are increased, thus resulting in degradation of the durability in use at high temperatures.

The SP value of each resin can be controlled by changing the monomer composition of the resin. More specifically, the SP value can be controlled by using a hydrophilic monomer when the SP value is to be increased, and by using a hydrophobic monomer when the SP value is to be decreased.

In the toner according to the embodiment of the present invention, a glass transition point TgH (° C.) of the polar resin H is 65.0 or higher and 85.0 or lower. TgH may be 65.0 or higher and 80.0 or lower, such as 65.0 or higher and 75.0 or lower. Because of TgH being related to Tg of the toner particle surface layer, when TgH is 65.0 or higher and 85.0 or lower, the storage stability of the toner in storage at high temperatures and the low-temperature fixation ability of the toner can be increased. If TgH is below 65.0, Tg of the toner particle surface layer is too low, thus causing degradation of the storage stability in storage at high temperatures. If TgH exceeds 85.0, Tg of the toner particle surface layer is too high, thus causing degradation of the low-temperature fixation ability.

In the toner according to the embodiment of the present invention, a glass transition point TgL (° C.) of the polar resin L is 75.0 or higher and 105.0 or lower. TgL may be 80.0 or higher and 95.0 or lower, such as 85.0 or higher and 95.0 or lower. When TgL is within the above-mentioned range, the durability of the toner in use at high temperatures and the low-temperature fixation ability of the toner can be increased. If TgL is below 75.0, Tg of the intermediate layer of the toner particle is too low and the Tg difference between the intermediate layer and the surface layer of the toner particle is increased, thus causing degradation of both the durability in use at high temperatures and the storage stability. If TgL exceeds 105.0, Tg of the intermediate layer of the toner particle is too high and the Tg difference between the intermediate layer and the surface layer of the toner particle is increased, thus causing degradation of both the durability in use at high temperatures and the low-temperature fixation ability.

Further, in the embodiment of the present invention, the difference (TgL−TgH) may be 30 or less. When (TgL−TgH) is within the above-mentioned range, the Tg difference between the intermediate layer and the surface layer of the toner particle is small, which contributes to facilitation of design. Accordingly, the durability in use at high temperatures and the storage stability of the toner can be further improved.

Tg of each resin can be controlled by changing the monomer composition and the molecular weight of the resin.

In the toner according to the embodiment of the present invention, weight-average molecular weight MwH of the polar resin H is $5.0\times10^3$ or more and $1.5\times10^4$ or less. MwH may be $5.0\times10^3$ or more and $1.0\times10^4$ or less, such as $6.0\times10^3$ or more and $9.0\times10^3$ or less. When MwH is within the above-mentioned range, the storage stability of the toner in storage at high temperatures, the durability of the toner in use at high temperatures, and the low-temperature fixation ability of the toner can be increased. If MwH is less than $5.0\times10^3$, the molecular weight of the toner particle surface layer is too low, thus causing degradation in both the durability of the toner in use at high temperatures and the storage stability of the toner in storage at high temperatures. If MwH exceeds $1.5\times10^4$, the molecular weight of the toner particle surface layer is too high, thus causing degradation in the low-temperature fixation ability of the toner. Further, viscosity of the particles during the granulation in the water-based medium is increased, thus causing degradation in the particle size distribution.

In the toner according to the embodiment of the present invention, weight-average molecular weight MwL of the polar resin L is $1.0\times10^4$ or more and $3.0\times10^4$ or less. MwL may be $1.2\times10^4$ or more and $2.0\times10^4$ or less, such as $1.2\times10^4$ or more and $1.8\times10^4$ or less. When MwL is within the above-mentioned range, the storage stability of the toner in storage at high temperatures, the durability of the toner in use at high temperatures, and the low-temperature fixation ability of the toner can be increased. If MwL is less than $1.0\times10^4$, the molecular weight of the intermediate layer of the toner particle is too low, thus causing degradation in both the durability of the toner in use at high temperatures and the storage stability of the toner in storage at high temperatures. If MwL exceeds $3.0\times10^4$, the molecular weight of the intermediate layer of the toner particle is too high, thus causing degradation in the low-temperature fixation ability of the toner. Further, viscosity of the particles during the granulation in the water-based medium is increased, thus causing degradation in the particle size distribution.

The molecular weight of each resin can be controlled by changing polymerization conditions.

In the toner according to the embodiment of the present invention, the content (parts by mass) of the polar resin H with respect to 100.0 parts by mass of the binding resin is 1.0 part by mass or more and 10.0 parts by mass or less. The content of the polar resin H may be 2.0 parts by mass or more and 8.0 parts by mass or less, such as 3.0 parts by mass or more and 6.0 parts by mass or less. When the content of the polar resin H is within the above-mentioned range, the toner particle surface layer can be formed in a proper thickness when the toner particle is granulated in the water-based medium. As a result, the storage stability of the toner in storage at high temperatures, the durability of the toner in use at high temperatures, and the low-temperature fixation ability of the toner can be increased. If the content of the polar resin H is less than 1.0 part by mass, the thickness of the toner particle surface layer is too thin, thus causing degradation in the durability of the toner in use at high temperatures and the storage stability of the toner in storage at high temperatures. If the content of the polar resin H exceeds 10.0 parts by mass, the thickness of the toner particle surface layer is too thick, thus causing degradation in the low-temperature fixation ability of the toner. Further, viscosity of the particles during the granulation in the water-based medium is increased, thus causing degradation in the particle size distribution.

In the toner according to the embodiment of the present invention, the content (parts by mass) of the polar resin L with respect to 100.0 parts by mass of the binding resin is 5.0 parts by mass or more and 25.0 parts by mass or less. The content of the polar resin L may be 5.0 parts by mass or more and 20.0 parts by mass or less, such as 10.0 parts by mass or more and 17.0 parts by mass or less. When the content of the polar resin L is within the above-mentioned range, the intermediate layer of the toner particle can be formed in a proper thickness. As a result, the storage stability of the toner in storage at high temperatures, the durability of the toner in use at high temperatures, and the low-temperature fixation ability of the toner can be increased. If the content of the polar resin L is less than 5.0 parts by mass, the thickness of the intermediate layer of the toner particle is too thin, thus causing degradation in the durability of the toner in use at high temperatures and the storage stability of the toner in storage at high temperatures. If the content of the polar resin L exceeds 25.0 parts by mass, the thickness of the intermediate layer of the toner particle is too thick, thus causing degradation in the low-temperature fixation ability of the toner. Further, viscosity of the particles during the granulation in the water-based medium is increased, thus causing degradation in the particle size distribution.

In the embodiment of the present invention, δH may be 10.00 or more and 12.00 or less, such as 10.20 or more and 11.00 or less. When δH is 10.00 or more and 12.00 or less, the shielding ability of the surface layer of the toner particle against the inner layer of the toner particle is further increased and the storage stability of the toner in storage at high temperatures is further increased. Further, since hydrophillicity of the surface layer of the toner particle is optimized, aggregation of the toner particles due to plasticization, which is caused with water absorption by the surface layer of the toner particle, is suppressed and the storage stability under high-humidity environments can be increased.

In the embodiment of the present invention, δL may be 8.80 or more and 10.00 or less, such as 8.90 or more and 9.30 or less. When δL is 8.80 or more and 10.00 or less, the adhesion between the inner layer and the intermediate layer of the toner particle is further increased and the durability of the toner in use at high temperatures can be further increased.

In the embodiment of the present invention, (δH−δL) may be 1.00 or more and 3.00 or less, such as 1.20 or more and 2.00 or less. When (δH−δL) is within the above-mentioned range, this condition contributes to forming the interface between the surface layer and the intermediate surface of the toner particle and is effective in further increasing the storage stability in storage at high temperatures.

In the embodiment of the present invention, an acid value AvB (mgKOH/g) of the binding resin may be 0.0 or more and 2.0 or less, an acid value AvH (mgKOH/g) of the polar resin H may be 5.0 or more and 20.0 or less, and an acid value AvL (mgKOH/g) of the polar resin L may be 8.0 or more and 25.0 or less. Further, the relationship of AvH<AvL is satisfied. More preferably, AvB is 0.0 or more and 1.0 or less, AvH is 5.0 or more and 10.0 or less, and AvL is 15.0 or more and 25.0 or less. When AvB, AvH and AvL are within the above-mentioned ranges, respectively, and the above-mentioned relationship is satisfied, the shielding ability of the surface layer of the toner particle against the inner layer of the toner particle can be increased. Consequently, the storage stability in storage at high temperatures is further increased. In addition, because of satisfying the relationship between AvH and AvL, the difference in acid value at the interface between the intermediate surface and the surface layer of the toner particle is reduced, the adhesion between the intermediate layer and the surface layer of the toner particle is further increased. As a result, chargeability is stabilized and the durability in use at high temperatures is further improved.

In the embodiment of the present invention, each of the polar resin H and the polar resin L may contain a hydroxyl group. A hydroxyl value OHvH (mgKOH/g) of the polar resin H is 15.0 or more and 30.0 or less, and a hydroxyl value OHvL (mgKOH/g) of the polar resin L is 8.0 or more and 25.0 or less. According to one aspect, OHvH is 20.0 or more and 30.0 or less, and OHvL is 8.0 or more and 15.0 or less. When OHvH and OHvL are within the above-mentioned ranges, respectively, charging stability of the toner in use under high-temperature/high-humidity environments is further improved.

The acid value and the hydroxyl value of each resin can be controlled by changing the monomer composition of the resin.

The polar resin H and the polar resin L used in the toner according to the embodiment of the present invention are not limited to particular types as long as the resin contains a carboxyl group. Examples of resins usable as the polar resin H and the polar resin L include vinyl-based resins containing a carboxyl group, such as copolymers of unsaturated carboxylic acid, e.g., acrylic acid or methacrylic acid, or unsaturated dicarboxylic acid, e.g., maleic acid, with a styrene-based monomer, e.g., styrene or α-methylstyrene, unsaturated carboxylic ester, e.g., methyl acrylate, butyl acrylate, methyl methacrylate, 2-hydroxyethyl methacrylate, t-butyl methacrylate, or 2-ethylhexyl methacrylate, unsaturated dicarboxylic anhydride, e.g., maleic anhydride, a nitrile-based vinyl monomer, e.g., acrylonitrile, a halogen-containing vinyl monomer, e.g., vinyl chloride, a nitro-based monomer, e.g., nitrostyrene, etc.; polyester-based resins containing a carboxylic group; polyurethane-based resins containing a carboxylic group; and polyamide-based resins containing a carboxylic group. Of those examples, the vinyl-based resin containing a carboxylic group is used as the polar resin L and the polyester-based resin containing a carboxylic group is used as the polar resin H, respectively, from the viewpoint of charging stability when the toner is left to stand at high temperatures, the adhesion between the inner layer and the intermediate layer of the toner particle, and the shielding ability of the surface layer of the toner particle against the inner layer of the toner particle. By using the vinyl-based polar resin and the polyester-based polar resin in combination, the durability in use at high temperatures, the charging stability, and the storage stability in storage at high temperatures are further improved.

In the embodiment of the present invention, the polar resin L may be the vinyl-based resin containing a carboxylic group, and the polar resin L contains a hydroxyl group. Further, AvL and OHvL of the polar resin L are in particular within the above-mentioned ranges, respectively. By using that type of the polar resin L in the toner, $|\delta L-\delta B|$ can be suitably controlled and the profile in the toner particle layers from the inner layer to the surface layer of the toner particle can be made closer to the conditions described above.

In the embodiment of the present invention, a peak molecular weight (also abbreviated to "Mp" hereinafter) of the polar resin L may be $1.0\times10^4$ or more and $3.0\times10^4$ or less. Further, when an acid value of a lower molecular weight component (having molecular weight in a range less than Mp) of the polar resin L is denoted by α (mgKOH/g) and an acid value of a higher molecular weight component (having molecular weight in a range of not less than Mp) thereof is denoted by β (mgKOH/g), $0.8\leqq\alpha/\beta\leqq1.2$ may be satisfied. When Mp, α and β satisfy the above-mentioned relationships, an acid value distribution in the intermediate layer is made uniform and the charging stability of the toner in use at high temperatures is further improved. Mp, α and β of the polar resin L can be controlled by changing reaction conditions in the polymerization reaction.

Examples of the binding resin usable in the toner include vinyl-based resins, polyester resins, polyamide resins, furan resins, epoxy resins, xylene resins, and silicone resins. Those resins can be used alone or in a mixed form. The vinyl-based resins can be provided as a homopolymer or a copolymer of monomers, such as a styrene-based monomer, e.g., styrene, α-methylstyrene, or divinylbenzene; unsaturated carboxylic ester, e.g., methyl acrylate, butyl acrylate, methyl methacrylate, 2-hydroxyethyl methacrylate, t-butyl methacrylate, or 2-ethylhexyl methacrylate; unsaturated carboxylic acid, e.g., acrylic acid or methacrylic acid; unsaturated dicarboxylic acid, e.g., maleic acid; unsaturated dicarboxylic anhydride, e.g., maleic anhydride; a nitrile-based vinyl monomer, e.g., acrylonitrile; a halogen-containing vinyl monomer, e.g., vinyl chloride; a nitro-based monomer, e.g., nitrostyrene, etc.

The colorant for use in the toner can be selected from among known pigments, dyes, magnetic bodies, etc. in black, yellow, magenta, cyan, and other colors. More specifically, a black colorant can be provided as, e.g., black pigment represented by carbon black, etc. A yellow colorant can be selected from among yellow pigments and yellow dyes represented by a monoazo compound, a disazo compound, a condensed azo compound, an isoindolinone compound, a benzimidazolone compound, an anthraquinone compound, an azo metal complex, a methine compound, and an allyl amide compound. A magenta colorant can be selected from among magenta pigments and magenta dyes represented by a monoazo compound, a condensed azo compound, a diketopyrrolopyrrole compound, an anthraquinone compound, a quinacridone compound, a base-dye lake compound, a naphtol compound, a benzimidazolone compound, a thioindigo compound, and a perylene compound. A cyan colorant can be selected from cyan pigments and cyan dyes represented by a copper phthalocyanine compound and a derivative thereof, an anthraquinone compound, and a base-dye lake compound.

Further, a magnetic toner can be provided by mixing a magnetic material as the colorant. In such a case, the magnetic material can serve also as the colorant. Examples of the magnetic material include iron oxides represented by magnetite, hematite, and ferrite, metals represented by iron, cobalt, and nickel, and an alloy or a mixture of at least one of the former metals and at least one of other metals, e.g., aluminum, cobalt, copper, lead, magnesium, tin, zinc, antimony, beryllium, bismuth, cadmium, calcium, manganese, selen (selenium), titanium, tungsten, and vanadium.

The toner according to the embodiment of the present invention may contain a polymer or a copolymer having a sulfonic group, a sulfonate group, or a sulfonic ester group (also referred to as a "polymer having a sulfonic group, etc." hereinafter). When the toner contains the polymer having a sulfonic group, etc., the charging stability in use at high temperatures is further increased. The polymer having a sulfonic group, etc. may be mixed in the toner in the range of 0.1 to 3.0 parts by mass with respect to 100.0 parts by mass of the binding resin. Examples of a monomer having a sulfonic group, which is used to produce the polymer having a sulfonic group, etc., include styrenesulfonic acid, 2-acrylamide-2-methylpropane sulfonic acid, 2-methacrylamide-2-methylpropane sulfonic acid, vinylsulfonic acid, and methacrylsulfonic acid. The polymer having a sulfonic group, etc. may be a homopolymer of one of the above-mentioned monomers, or a copolymer of one or more of the above-mentioned monomers and one or more other monomers. The monomers forming the copolymers with the above-mentioned monomers may be, e.g., the vinyl-based monomers described above regarding the materials of the binding resin.

The toner according to the embodiment of the present invention may contain a charge control agent. Examples of the charge control agent include metal compounds of aromatic carboxylic acids represented by a salicylic acid, alkylsalicylic acid, dialkylsalicylic acid, naphthoic acid, and dicarboxylic acid; metal salts or metal complexes used as azo dyes or azo pigments; boron compounds; silicon compounds, and calixarene. Further, examples of a positive charge control agent include a quaternary ammonium salt, a polymer compound having a quaternary ammonium salt in a side chain, a guanidine compound, a nigrosine-based compound, and an imidazol compound. An amount of the charge control agent is determined depending on the type of the binding resin, the presence of other additives, and a toner producing method including a dispersion method, and the amount is not uniquely limited. When the charge control agent is mixed in the toner particle, it is mixed in the range of 0.1 to 10 parts by mass, such as 0.1 to 5 parts by mass with respect to 100 parts by mass of the binding resin. When the charge control agent is externally added to the toner particle, it may be added in the range of 0.005 to 1.0 part by mass, such as 0.01 to 0.3 part by mass with respect to 100.0 parts by mass of the toner particle.

The toner according to the embodiment of the present invention may contain wax as a releasing agent. Examples of the wax include petroleum-based waxes, e.g., paraffin wax, microcrystalline wax, and petrolatum, and derivatives thereof; montan wax and derivatives thereof; hydrocarbon waxes produced with the Fisher-Tropsh process and derivatives thereof; polyolefin waxes, e.g., polyethylene wax and polypropylene wax, and derivatives thereof; natural waxes, e.g., carnauba wax and candellila wax, and derivatives thereof; highly fatty alcohols; fatty acids, e.g., stearic acid and palmitic acid; acid amide waxes; ester waxes; hardened castor oil and derivatives thereof; vegetable waxes; and animal waxes. Of those examples, paraffin wax, ester waxes, and hydrocarbon waxes may be provided from the viewpoint of excellence in releasing property. The wax may be mixed in the range of 1.0 to 40.0 parts by mass and more, such as 3.0 to 25.0 parts by mass with respect to 100.0 parts by mass of the binding resin. When the wax content is in the range of 1.0 to 40.0 parts by mass, a proper bleeding property of the wax is ensured under application of heat and pressure to the toner, and wrapping resistance at high temperatures is increased. Further, even when the toner is subjected to stresses during development and transfer processes, the wax is exposed in a less amount to the toner surface, and uniform charging of individual toners can be ensured.

The toner according to the embodiment of the present invention may be added with a fluidity improver for the purpose of improving fluidity. Examples of the fluidity improver include fluorine-based resin powder, e.g., vinylidene fluoride fine powder and polytetrafluoroethylene fine powder; metal salts of fatty acids, e.g., zinc stearate, calcium stearate, and lead stearate; powder of metal oxides, e.g., titanium oxide powder, aluminum oxide powder, and zinc oxide powder, or powder obtained with hydrophobizing treatment of the metal oxides; and silica fine powder, e.g., silica produced by a wet process and silica produced by a dry process, or surface-treated silica fine powder obtained by surface-treating the former silica with a processing agent such as a silane coupling agent, a titanium coupling agent, or silicone oil. The fluidity improver may be mixed in the range of 0.01 to 5 parts by mass with respect to 100.0 parts by mass of the toner particle.

The toner particle used in the embodiment of the present invention is produced by a production method including a granulation step performed in the water-based medium. In more detail, examples of the production method include a suspension granulation method of dissolving or dispersing toner components in an organic solvent, and volatilizing the organic solvent after the granulation in the water-based medium; a suspension polymerization method of directly granulating and polymerizing a polymerizable monomer composition, in which toner components are dissolved or dispersed, in the water-based medium; a method of, subsequent to the suspension polymerization process, forming a surface layer on a toner by utilizing seed polymerization; and a microcapsule method represented by interface polycondensation and liquid drying. Of those examples, the suspension polymerization method may be provided in some cases. According to the suspension polymerization method, a polymerizable monomer composition is prepared by uniformly dissolving or dispersing a colorant (and optionally other additives, e.g., a polymerization initiator, a cross-coupling agent, wax, and a charging control agent) in a polymerizable monomer. Then, the prepared polymerizable monomer composition is dispersed into a water-based medium, which contains a dispersion stabilizer, by using an appropriate stirring apparatus, so as to polymerize the polymerizable monomer in the polymerizable monomer composition. A toner particle having a predetermined diameter is thereby obtained. After the polymerization, the toner particle is subjected to filtration, washing and drying with known methods, and the fluidity improver is mixed to adhere onto the toner particle surface, whereby the toner can be obtained.

In the embodiment of the present invention, by producing the toner with the suspension polymerization method, the three-layer structure of the toner particle made up of the inner layer, the intermediate layer, and the surface layer is obtained in a more homogeneous state. Thus, the storage stability in storage at high temperatures and the durability in use at high temperatures are further improved. Moreover, since individual toner particles have substantially spherical shapes, it is easier to obtain the toner having a comparatively uniform distribution of charge amount and satisfying the predetermined development characteristic. It is also easier to obtain the toner having less dependency upon externally added agents and maintaining high transferability. The above-mentioned vinyl polymerizable monomer is one example of the polymerizable monomer that is used when the toner is produced by the suspension polymerization method.

An oil soluble initiator and/or a water soluble initiator is used as the polymerization initiator. The polymerization initiator may have a half-life period of 0.5 to 30 hours at the reaction temperature in the polymerization reaction. Usually, when the polymerization reaction is developed by adding the polymerization initiator in the range of 0.5 to 20.0 parts by mass with respect to 100.0 parts by mass of the polymerizable monomer, a polymer having peak molecular weight of 10000 to 100000 is produced, and the toner having proper strength and melting characteristic can be obtained.

Examples of the polymerization initiator include azo- or diazo-based polymerization initiators, e.g., 2,2'-azobis-(2,4-dimethylvaleronitrile), 2,2'-azobisisobutylonitrile, 1,1'-azobis(cycrohexane-1-carbonitrile), 2,2'-azobis-4-methoxy-2,4-dimethylvaleronitrile, and azobisisobutylonitrile; and peroxide-based polymerization initiators, e.g., benzoyl peroxide, t-butylperoxy 2-ethylhexanoate, t-butylperoxypivalate, t-butylperoxyisobutylate, t-butylperoxyneodecanoate, methyl ethyl ketone peroxide, diisopropyl peroxycarbonate, cumene hydroperoxide, 2,4-dichlorobenzoyl peroxide, and lauroyl peroxide. Other known additives, such as a chain transfer agent and a polymerization inhibitor, can be further added to control a polymerization degree of the polymerizable monomer.

An inorganic or organic dispersion stabilizer may be added to the water-based medium. Examples of inorganic compounds usable as the dispersion stabilizer include hydroxy apatite, calcium tertiary phosphate, calcium secondary phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica, and alumina. Examples of organic compounds usable as the dispersion stabilizer include polyvinyl alcohol, gelatin, methyl cellulose, methylhydroxypropyl cellulose, ethyl cellulose, sodium salt of carboxymethyl cellulose, polyacrylic acid and polyacrylate, and starch. The dispersion stabilizer is may be added in the range of 0.2 to 20.0 parts by mass with respect to 100.0 parts by mass of the polymerizable monomer. A surfactant may be used to finely disperse the dispersion stabilizer. The surfactant serves to promote the intended action of the dispersion stabilizer. Examples of the surfactant include sodium dodecylbenzenesulfate, sodium tetradecylsulfate, sodium pentadecylsulfate, sodium octylsulfate, sodium oleate, sodium laurate, potassium stearate, and calcium oleate. When the inorganic compound is used as the dispersion stabilizer, a commercially available compound may be used as it is, but the inorganic compound may be produced in the water-based medium to obtain finer particles. For example, when calcium phosphates, such as hydroxyl apatite and calcium tertiary phosphate, are used, they may be prepared by mixing a phosphate aqueous solution and a calcium-salt aqueous solution under strong stirring.

When the toner particle is produced by the suspension polymerization method, the process may include, prior to a granulation step in the water-based medium, a step of processing the polymerizable monomer composition by using a stirring apparatus described below. One type of the stirring apparatus includes stirring blades rotating at a high speed to process the polymerizable monomer and a screen disposed around the stirring blades and rotated at a high speed in a direction reversed to a rotating direction of the stirring blades. In another type of the stirring apparatus, a rotor including ring-like projections, each provided with a plurality of slits, arranged in concentric multiple stages and a stator having a similar shape to that of the rotor are coaxially disposed in an interdigitated relation with a certain gap left therebetween. With the processing using one of the above-described stirring apparatuses, the polar resin H and the polar resin L are more homogeneously dispersed in the polymerizable monomer composition, and the three-layer structure of the toner particle made up of the inner layer, the intermediate layer, and the surface layer are more homogeneously formed. As a result, the storage stability in storage at high temperatures and the durability in use at high temperatures are further improved. In addition, since polar groups, such as a carboxylic group, are more uniformly distributed in the toner, the charging stability in environments at high temperatures is also improved.

Figure 1B:
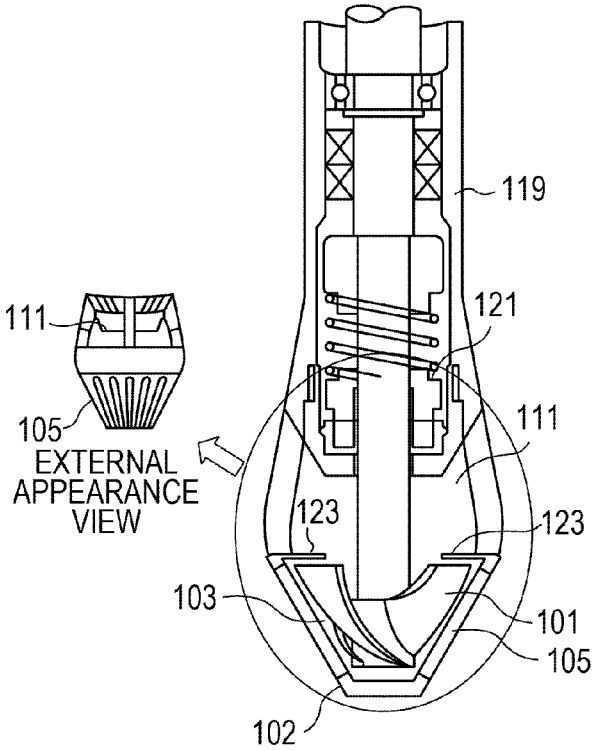
Figure 1C:
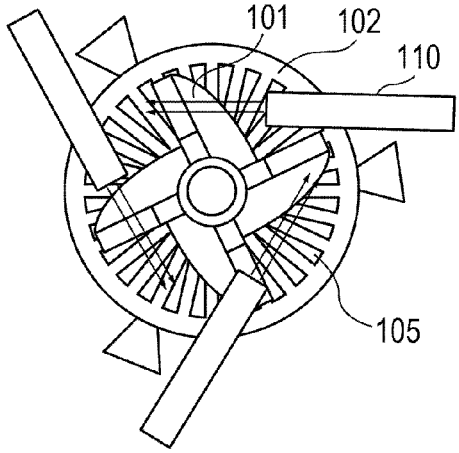

An example of the above-described stirring apparatus, which includes stirring blades rotating at a high speed and a screen disposed around the stirring blades and rotated at a high speed in a direction reversed to a rotating direction of the stirring blades, is illustrated in FIGS. 1A to 1C. FIG. 1A is an overall view of the stirring apparatus, and FIGS. 1B and 1C are each a sectional view of a stirring section. With stirring blades 101 rotated at a high speed inside a stirring chamber 103, the polymerizable monomer composition put in a dispersion container 104 is subjected to shearing forces in small gaps between an inner wall of a screen 102 and blade tips, and the polar resins in the polymerizable monomer composition are dispersed. Because the screen 102 defining the stirring chamber 103 and the stirring blades 101 are rotated in the reversed directions, their relative rotational speeds can be increased and shearing forces acting on re-aggregated pigments can be increased. As a result, the polar resins can be more highly dispersed than the case using known stirring apparatuses.

Because ejection ports 105 of the stirring chamber 103 are rotated in the direction reversed to the rotating direction of the stirring blades 101, a fluid ejection position is changed with the rotation, and the polymerizable monomer composition is well circulated within the dispersion container 104. Further, because ejection flows passing through the discharge ports 105 are added to an ejection flow caused with the rotation of the stirring blades 101 that are rotated while keeping small gaps relative to the ejection ports 105, a faster ejection flow is generated to further promote overall circulation.

Because inlets 110 are disposed above the stirring blades 101 inside the stirring chamber 103, the polymerizable monomer composition can be processed such that, after being put into the dispersion container 104 through the inlets 110, the polymerizable monomer composition undergoes fast shearing forces from the stirring blades 101 and the screen 102, which are rotated in the reversed directions at the high speeds, and then passes through the ejection ports 105 from the interior of the stirring chamber 103. In other words, it is possible to suppress a phenomenon (shortcut) that the polymerizable monomer composition is returned to an adjusting tank 107 without passing through the ejection ports 105, i.e., without being subjected to the fast shearing process. Hence, the dispersion time can be shortened.

The dispersion container 104 has a jacket structure. By supplying a coolant so as to flow through a jacket, the temperature of the polymerizable monomer composition, which has been heated by being subjected to the shearing inside the dispersion container 104, can be lowered.

FIG. 1A is an overall view of the stirring apparatus of which stirring section, illustrated in FIGS. 1B and 1C, is installed in a circulation line. After loading the polymerizable monomer and the resins into the adjusting tank 107, the polymerizable monomer composition is mixed by using a stirrer 108 disposed within the adjusting tank 107 and is supplied from the inlets 110 to suction ports 111 through a circulation pump 109. Then, the polymerizable monomer composition is introduced to the stirring chamber 103 from the suction ports 111 and is ejected through the ejection ports 105 after having passed through the above-mentioned small gaps. The ejected polymerizable monomer composition is discharged through an outlet 112 after circulating inside the dispersion container 104, and is returned to the stirring tank 107 through a heat exchanger 113. The polymerizable monomer composition returned to the adjusting tank 107 is supplied to the inlets 110 again in a repeated manner for recirculation. By repeating the circulation between the disperser and the adjusting tank 107, the polar resins in the polymerizable monomer composition are homogeneously and efficiently dispersed. A position inside the adjusting tank 107 to which the polymerizable monomer composition having been subjected to the fast shearing process is returned may be located inside the polymerizable monomer composition stored in the adjusting tank 107. By returning the polymerizable monomer composition, which has been subjected to the fast shearing process, into the polymerizable monomer composition stored in the adjusting tank 107, entrainment of gas into the polymerizable monomer composition can be avoided. The entrainment of gas into the polymerizable monomer composition is disadvantageous in accelerating generation of cavitation during the fast shearing process in the stirring chamber 103 and reducing dispersion efficiency.

The heat exchanger 113 is not always required to be disposed in the circulation line, and a coil-type heat exchange line may be installed inside the dispersion container 104. A flow rate of the processed polymerizable monomer composition is measured by a flow meter 114 disposed in the circulation path. Further, a pressure adjusting valve 115 may be provided to apply a backpressure. Applying the backpressure is effective in suppressing generation of cavitation that may be caused with the rotations of the stirring blades 101 and the screen 102, and contributes to more effectively exerting the shearing forces onto the processed liquid. As a result, the polar resins in the polymerizable monomer composition can be dispersed with higher efficiency. For that reason, in the embodiment of the present invention, the backpressure may be appropriately applied during the fast shearing process. A range of the backpressure may be 50 kPa or higher and 150 kPa or lower. For example, CREAMIX W MOTION (M Technique Co., Ltd.) can be suitably used as the above-described disperser.

Figure 2A:
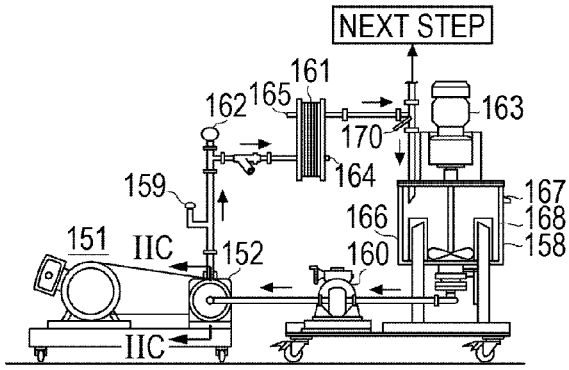
FIGS. 2A to 2F are explanatory views of a stirring apparatus having a stator and a rotor.
Figure 2B:
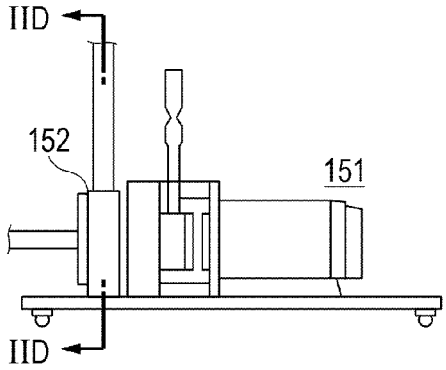
Figure 2C:
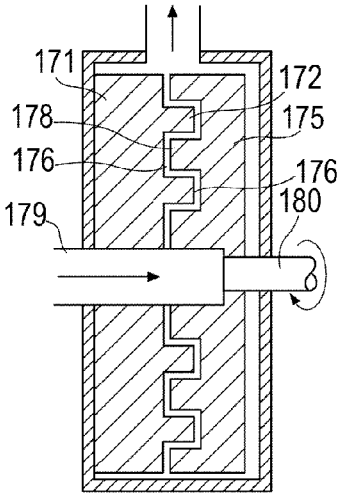
Figure 2D:
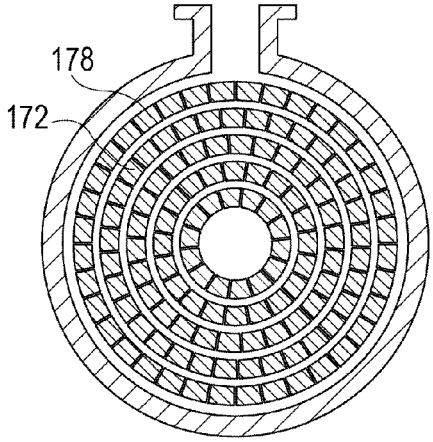
Figure 2E:
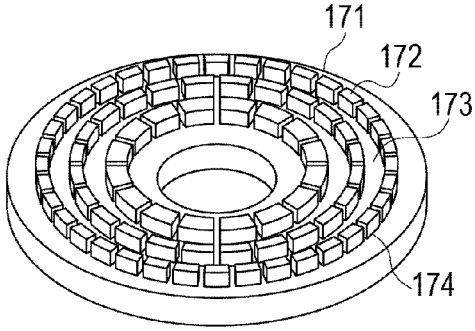
Figure 2F:
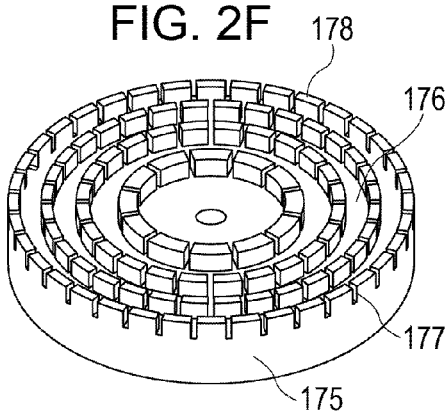

An example of the stirring apparatus, in which a rotor including ring-like projections, each provided with a plurality of slits, arranged in concentric multiple stages and a stator having a similar shape to that of the rotor are coaxially disposed in an interdigitated relation with a certain gap left therebetween, will be described below. FIG. 2A is an overall view of the stirring apparatus, FIG. 2B is a side view of the stirring apparatus, and FIG. 2C is a sectional view of a stirring section taken along a line IIC-IIC in FIG. 2A. FIG. 2D is a sectional view of the stirring section taken along a line IID-IID in FIG. 2B, FIG. 2E is a perspective view of the rotor, and FIG. 2F is a perspective view of the stator. A preparation liquid is obtained by loading, into a holding tank 158, a colorant-containing monomer, i.e., a polymerizable monomer in which at least a colorant is dispersed, from a dispersion step and resin-containing monomers, i.e., polymerizable monomers in which at least polar resins are dissolved, from a dissolution step. The preparation liquid is supplied to an inlet of a mixer through a circulation pump 160. In the mixer, the preparation liquid passes through slits of a rotor 175 and a stator 171, which are disposed within a casing 152, and it is then discharged in the centrifugal direction. When the preparation liquid passes through the inside of the mixer, it is mixed by undergoing compression caused in the centrifugal direction due to shifts in positions of the slits between the rotor and the stator, impacts caused by discharging, and impacts caused by shearing occurred between the rotor and the stator. According to one aspect, the rotor and the stator are each formed in the shape obtained by forming the ring-like projections, each provided with the plurality of slits, in concentric multiple stages, and they are coaxially disposed in an interdigitated relation with a certain gap left therebetween.

Because the rotor and the stator are disposed in an interdigitated relation, the possibility of shortcut is reduced and the preparation liquid can be sufficiently dispersed. Further, because the rotor and the stator are concentrically alternately disposed in multiple stages, the preparation liquid is subjected to more shearing and stronger impacts when it advances in the centrifugal direction. Therefore, a dispersion level of the polar resins can be further increased. The holding tank 158 has a jacket structure such that the liquid under processing can be cooled and heated. For example, CAVITRON (EUROTEC, LTD.) can be suitably used as the above-described mixer.

The toner according to the embodiment of the present invention can be employed in known image forming methods without especial limitations. Examples of the known image forming methods include a nonmagnetic single-component contact development method, a magnetic single-component jumping development method, and a two-component jumping development method.

Methods for measuring physical values used in the embodiment of the present invention will be described below.

(SP Values of Polar Resin and Binding Resin)

Solubility parameters (SP values) of the polar resin and the binding resin are measured by a turbidimetric titration method as follows. First, about 0.5 g of the resin is weighed and put in a 100-ml beaker. Then, acetone (SP value $\delta g=9.77$ $(cal/cm^3)^{1/2}$) is added, as a good solvent for the resin, to the resin by using a 10-ml whole pipette and is stirred by using a magnetic stirrer. The resin is dissolved in the acetone and a sample is prepared. Then, hexane (SP value $\delta p1=7.24$ $(cal/cm^3)^{1/2}$) is dropped, as a poor solvent having a low SP value, into the sample by using a 50-ml burette. From the amount of dropped hexane at the time when turbidity has occurred, a volume fraction $\phi p1$ of the hexane at that time is determined. Then, methanol (SP value $\delta ph=14.50$ $(cal/cm^3)^{1/2}$) is dropped, as a poor solvent having a high SP value, into the sample by using a 50-ml burette. From the amount of dropped methanol at the time when turbidity has occurred, a volume fraction $\phi ph$ of the methanol at that time is determined. An SP value $\delta ml$ of the resin at the turbidity occurred with dropping of hexane and an SP value $\delta mh$ of the resin at the turbidity occurred with dropping of methanol can be determined from the following formulae (1) and (2), respectively. Further, an average value of $\delta ml$ and $\delta mh$ is an SP value $\delta$ of the resin, and it can be determined from the following formula (3).

$$\delta ml=\phi pl\times\delta pl+(1-\phi pl)\delta g \quad (1)$$

$$\delta mh=\phi ph\times\delta ph+(1-\phi ph)\delta g \quad (2)$$

$$\delta=(\delta ml+\delta mh)/2 \quad (3)$$

While acetone, hexane, and methanol are used herein respectively as the good solvent, the poor solvent having a low SP value, and the poor solvent having a high SP value, other types of solvents having known SP values can be used, as appropriate, when the resin is hard to dissolve in the solvent(s), or when turbidity is hard to occur.

(Glass Transition Temperature Tg of Polar Resin)

The glass transition temperature Tg of the polar resin is measured in conformity with ASTM D3418-82 by using a differential scanning calorie analyzer "Q1000" (TA Instruments Co.). Temperature correction for a detecting section of the analyzer is performed by using the melting points of indium and zinc, and calorie correction is performed by using heat of fusion of indium.

In more detail, about 10 mg of the polar resin is precisely weighed and is put in an aluminum-made pan. Another vacant aluminum-made pan is used as a reference. Measurement is performed in the temperature range of 30 to 200° C. at a temperature rising rate of 10° C./min. In the course of temperature rising, change of specific heat occurs in the temperature range of 40 to 100° C. A point at which a line passing a middle point of a base line between before and after the occurrence of change of specific heat intersects a differential heat curve is regarded as indicating the glass transition temperature Tg of the polar resin.

(Molecular Weight of Polar Resin)

A molecular weight distribution of the polar resin is measured by a gel permeation chromatography (GPC) as follows. First, the polar resin is dissolved in tetrahydrofuran (THF) at room temperature for 24 hours. A resultant solution is filtrated by using a solvent-resistant membrane filter with a bore diameter of 0.2 μm "Maishori Disk" (TOSOH CORPORATION), to thereby obtain a sample solution. The sample solution is adjusted such that the concentration of a component dissoluble in THF is about 0.8% by mass. The measurement is performed by using the obtained sample solution under the following conditions:

Apparatus: HLC8120 GPC (detector: RI) (TOSOH CORPORATION)

Column: 7 series of Shodex KF-801, 802, 803, 804, 805, 806 and 807 (Showa Denko K. K.)

Eluant: tetrahydrofuran (THF)

Flow rate: 1.0 ml/min

Oven temperature: 40.0° C.

Injected amount of sample: 0.10 ml

The molecular weight of the sample is calculated based on a molecular weight calibration curve that is prepared by using standard polystyrene resins (e.g., trade names "TSK Standard Polystyrene F-850, F-450, F-288, F-128, F-80, F-40, F-20, F-10, F-4, F-2, F-1, A-5000, A-2500, A-1000, and A-500" TOSOH CORPORATION).

(Acid Values of Polar Resin and Binding Resin)

Acid values of the polar resin and the binding resin are measured as follows. The acid value is provided as an amount (mg) of potassium hydroxide, which is provided to neutralize an acid contained in 1 g of the sample. The acid value of each of the polar resin and the binding resin is measured in conformity with JIS K 0070-1992. In more detail, the acid value is measured in accordance with the following procedures.

(1) Preparation of Reagents

A phenolphthalein solution is obtained by dissolving 1.0 g of phenolphthalein in 90 ml of ethyl alcohol (95 vol %), and by adding ion exchanged water until reaching a total volume of 100 ml. 7 G of analytical-grade potassium hydroxide is dissolved in 5 ml of water and ethyl alcohol (95 vol %) is added until reaching a total volume of 1 liter. After leaving the mixture to stand for three days in an alkali-resistant container in a state kept away from carbon dioxide, etc., it is filtrated to obtain a potassium hydroxide solution. The obtained potassium hydroxide solution is stored in an alkali-resistant container. A factor of the potassium hydroxide solution is obtained by putting 25 ml of 0.1-mol/l hydrochloric acid in a conical (Erlenmeyer) flask, adding several droplets of the phenolphthalein solution, performing titration with the potassium hydroxide solution, and determining an amount of the potassium hydroxide solution, which has been provided for neutralization. The 0.1-mol/l hydrochloric acid is prepared in conformity with JIS K 8001-1998.

(2) Operations (A) Main Test 2.0 G of a sample obtained by pulverizing each of the polar resin and the binding resin is precisely weighed and put in a 200-ml conical flask, and 100 ml of a mixed solution of toluene/ethanol (2:1) is added to dissolve the sample for 5 hours. Then, several droplets of the phenolphthalein solution are added as an indicator, and titration is performed by using the potassium hydroxide solution. The end point of the titration is determined to be a point in time when a light red color of the indicator has continued for about 30 seconds.

(B) Blank Test

Titration is performed in the same manner as that in the above-described main test except that the sample is not employed (namely, only the mixed solution of toluene/ethanol (2:1) is employed).

(3) The acid value is calculated by substituting the obtained results into the following formula:

$$A=[(C-B)\times f\times 5.61]/S$$

where A: acid value (mgKOH/g), B: amount (ml) of the potassium hydroxide solution added in the blank test, C: amount (ml) of the potassium hydroxide solution added in the main test, f: factor of the potassium hydroxide solution, and S: amount (g) of the sample.

(Hydroxyl Value of Polar Resin)

A hydroxyl value is provided as an amount (mg) of potassium hydroxide, which is provided to neutralize acetic acid coupled to a hydroxyl group when 1 g of the sample is acetylated. The hydroxyl value of the polar resin is measured in conformity with JIS K 0070-1992. In more detail, the hydroxyl value is measured in accordance with the following procedures.

(1) Preparation of Reagents

An acetylation reagent is obtained by putting 25 g of analytical-grade acetic anhydride in a 100-ml volumetric flask, adding pyridine until reaching a total volume of 100 ml, and sufficiently shaking and mixing the mixture. The obtained acetylation reagent is stored in a brown bottle in a state kept away from moisture, carbon dioxide, etc. A phenolphthalein solution is obtained by dissolving 1.0 g of phenolphthalein in 90 ml of ethyl alcohol (95 vol %), and adding ion exchanged water until reaching a total volume of 100 ml.

35 G of analytical-grade potassium hydroxide is dissolved in 20 ml of water and ethyl alcohol (95 vol %) is added until reaching a total volume of 1 liter. After leaving the mixture to stand for three days in an alkali-resistant container in a state kept away from carbon dioxide, etc., it is filtrated to obtain a potassium hydroxide solution. The obtained potassium hydroxide solution is stored in an alkali-resistant container. A factor of the potassium hydroxide solution is obtained by putting 25 ml of 0.5-mol/l hydrochloric acid in a conical flask, adding several droplets of the phenolphthalein solution, performing titration with the potassium hydroxide solution, and determining an amount of the potassium hydroxide solution, which has been provided for neutralization. The 0.5-mol/l hydrochloric acid is prepared in conformity with JIS K 8001-1998.

(2) Operations (A) Main Test 1.0 G of a sample obtained by pulverizing the polar resin is precisely weighed and put in a 200-ml round-bottom flask, and 5.0 ml of the acetylation reagent is precisely added to the sample by using a whole pipette. At that time, when the sample is hard to dissolve in the acetylation reagent, a small amount of analytical-grade toluene is added to dissolve the sample. A small funnel is put on the mouth of the flask, and a bottom portion (about 1 cm in height) of the flask is dipped in a glycerin bath at about 97° C. for heating. At that time, a thick paper sheet having a round hole formed therein is fitted to the root of the flask neck to prevent the temperature of the flask neck from rising with heat from the glycerin bath. After 1 hour, the flask is taken out from the glycerin bath and is left to stand for radiational cooling. After the radiational cooling, 1 ml of water is added through the funnel to hydrolyze the acetic anhydride while shaking the flask. To completely hydrolyze the acetic anhydride, the flask is heated again in the glycerin bath for 10 minutes. After radiational cooling, walls of the funnel and the flask are washed with 5 ml of ethyl alcohol.

Several droplets of the phenolphthalein solution are added as an indicator, and titration is performed by using the potassium hydroxide solution. The end point of the titration is determined to be a point in time when a light red color of the indicator has continued for about 30 seconds.

(B) Blank Test

Titration is performed in the same manner as that in the above-described main test except that the sample of the polar resin is not employed.

(3) The hydroxyl value is calculated by substituting the obtained results into the following formula:

$$A=[\{(B-C)\times 28.05\times f\}/S]+D$$

where A: hydroxyl value (mgKOH/g), B: amount (ml) of the potassium hydroxide solution added in the blank test, C:

amount (ml) of the potassium hydroxide solution added in the main test, f: factor of the potassium hydroxide solution, S: amount (g) of the sample, and D: acid value (mgKOH/g) of the binding resin.

(Fractionation of Polar Resin Based on Molecular Weight and Measurement of Acid Value thereof)

Fractionation of the polar resin based on molecular weight is performed as follows.

[Apparatus Configuration]

LC-908 (Japan Analytical Industry Co., Ltd.)

JRS-86 (Repeat Injector made by Japan Analytical Industry Co., Ltd.)

JAR-2 (Auto-sampler made by Japan Analytical Industry Co., Ltd.)

FC-201 (Fraction Collector made by GILSON Co.)

[Column Configuration]

JAIGEL-1H-5H (2ϕ×600 mm; fractionation column)

[Measurement Conditions]

Temperature: 40° C.

Solvent: THF

Flow rate: 5 ml/min

Detector: RI

An elution time providing the peak molecular weight Mp of the polar resin is measured in advance, and a low molecular weight component and a high molecular weight component are fractionated before and after the elution time. A sample for measurement of the acid value is obtained by removing the solvent from the fractionated sample. The measurement of the acid value is performed in accordance with the method described above in (Acid Value of Polar Resin and Binding Resin).

(Weight-Average Particle Diameter (D4) and Number-Average Particle Diameter (D1) of Toner Particles and Toner)

A weight-average particle diameter (D4) and a number-average particle diameter (D1) of the toner particles and the toner are obtained by using, for measurement and analysis of the measured data, both of a precision particle-size distribution measuring apparatus "COULTER Counter Multisizer 3" (registered trademark, BECKMAN COULTER Co.), which includes a 100-μm aperture tube and which operates based on the pore electrical resistance method, at the effective measurement channel number of 25,000, and appending dedicated software "BECKMAN COULTER Multisizer 3 Version 3.51" (BECKMAN COULTER Co.), which is adapted for setting measurement conditions and analyzing measured data. An electrolytic aqueous solution for use in the measurement is a solution prepared by dissolving analytical-grade sodium chloride in ion exchanged water and adjusting the concentration of the sodium chloride to about 1% by mass. For example, "ISOTON II" (BECKMAN COULTER Co.) is available.

Before starting the measurement and the analysis, settings of the dedicated software are carried out as follow. On "Screen for changing standard measurement method (SOM)" presented by the dedicated software, the total count number in the control mode is set to 50000 particles, the number of measurements is set to one, and the Kd value is set to a value obtained by using "Standard Particle 10.0 μm" (BECKMAN COULTER Co.). The threshold and the noise level are automatically set by pushing a measurement button for a threshold/noise level. Further, the current is set to 1600 μA, and the gain is set to 2. The electrolyte is set to ISOTON II, and a check mark is put on flushing of the aperture tube after the measurement. On "Screen for setting conversion from pulse to particle diameter" presented by the dedicated software, the bin interval is set to a logarithmic particle diameter, the particle diameter bins are set to 256 particle size bins, and the particle diameter range is set to 2 μm to 60 μm.

Details of the measurement method are as follows.

(1) About 200 ml of the above-mentioned electrolytic aqueous solution is put in a 250-ml round-bottom glass beaker, which is dedicated for "Multisizer 3", and is set on a sample stand. The electrolytic aqueous solution is stirred by rotating a stirrer rod counterclockwise at 24 revolutions/sec (rps). Then, contaminants and bubbles in the aperture tube are removed with the "Aperture Flushing" function of the analysis software.

(2) About 30 mol of the above-mentioned electrolytic aqueous solution is put in a 100-ml flat-bottom glass beaker, and about 0.3 ml of a diluent is added, as a dispersant, to the electrolytic aqueous solution. The diluent is prepared by diluting "Contaminon N" (aqueous solution of 10% by mass of a natural detergent (pH 7) for washing precision measuring equipment, which contains a nonionic surfactant, an anionic surfactant, and an organic builder, and which is made by Wako Pure Chemical Industries, Ltd.) triple in terms of mass with ion exchanged water.

(3) A predetermined amount of ion exchanged water is put in a water tank of an ultrasonic disperser "Ultrasonic Dispersion System Tetora 150" (Nikkaki-Bios Co., Ltd.), which has an electrical output of 120 W and includes two oscillators each having oscillation frequency of 50 kHz and installed in a state shifted in phase by 180 degrees, and about 2 ml of Contaminon N is added into the water tank.

(4) The beaker mentioned in above (2) is set in a beaker fixing hole of the ultrasonic disperser, and operation of the ultrasonic disperser is started. The height position of the beaker is adjusted such that the resonance state of a liquid surface of the electrolytic aqueous solution in the beaker is maximized.

(5) In the state of above (4) where the electrolytic aqueous solution in the beaker is irradiated with ultrasonic waves, about 10 mg of the toner is added to the electrolytic aqueous solution a little by a little to be dispersed therein. The ultrasonic dispersion process is further continued for 60 seconds. During the ultrasonic dispersion process, the water temperature in the water tank is adjusted, as appropriate, to be held at 10° C. or higher and 40° C. or lower.

(6) The electrolytic aqueous solution in which the toner has been dispersed in above (5) is dropped into the round-bottom beaker, which has been set on the sample stand in above (1), by using a pipette. The measurement concentration is adjusted to be held at about 5%. The measurement is continued until the number of measured particles reaches 50000.

(7) The measured data is analyzed by using the dedicated software appended to the measuring apparatus, thereby obtaining the weight-average particle diameter (D4) and the number-average particle diameter (D1). The weight-average particle diameter (D4) is provided as an "average diameter" on a screen of "Analysis/volume statistical value (arithmetic value)" when "graph/volume %" is set in the dedicated software, and the number-average particle diameter (D1) is provided as an "average diameter" on a screen of "Analysis/number statistical value (arithmetic value)" when "graph/number %" is set in the dedicated software.

(Percentage of Particles of 4 μm or Smaller in Toner and Toner Particles)

A percentage (number %) of particles of 4 μm or smaller in the toner is obtained by analyzing the measured data after performing the measurement with the above-mentioned "Multisizer 3".

In more detail, the number % of particles of 4 μm or smaller in the toner is obtained in accordance with the following procedures. First, "graph/number %" is set in the dedicated software such that a chart plotting the measured result is represented in terms of number %. Then, a check mark is put on "<" in a particle diameter setting section on a screen of "Format/particle diameter/particle diameter statistics", and "4" is entered in a particle diameter input section that is positioned under the particle diameter setting section. The number % of particles of 4 μm or smaller in the toner is provided as a numerical value in a display section of "<4 μm" when the screen of "Analysis/number statistical value (arithmetic value)" is displayed.

EXAMPLES

The present invention will be described in more detail below in connection with EXAMPLES. Be it noted that values of "part(s)" and "%" in EXAMPLES and COMPARATIVE EXAMPLES are all represented on the basis of mass unless otherwise specified.

[Example of Producing Polar Resin]

<Polar Resin A1>

300 Parts by mass of xylene (boiling point 144° C.) were put in an autoclave provided with a depressurization apparatus, a water separator, a nitrogen gas introducing apparatus, a temperature measuring device, and a stirrer. After sufficiently replacing an atmosphere in a container with nitrogen under stirring, the xylene was circulated under heating. In the circulated state, a mixed solution of;

| | |
|---|---|
| styrene | 91.7 parts by mass |
| methyl methacrylate | 2.5 parts by mass |
| methacrylic acid | 3.3 parts by mass |
| 2-hydroxyethyl methacrylate | 2.5 parts by mass |
| initiator: di-tert-butylperoxide | 2.0 parts by mass |

was added to the xylene. Polymerization was then developed for 5 hours by setting the polymerization temperature to 170° C. and the pressure during the reaction to 0.150 MPa. Thereafter, a solvent removing step was performed for 3 hours under depressurization to remove the xylene, and a polar resin A1 was obtained through pulverization. Physical properties of the polar resin A1 are listed in Table 2.

<Polar Resins A2 to A33>

Polar resins A2 to A33 were synthesized in a similar manner to that used in the above example of producing the polar resin A1 except for changing the monomer composition, the amount of the initiator, the pressure during the reaction, and the reaction temperature as listed in Table 1. Physical properties of the polar resins A2 to A33 are listed in Table 2. Be it noted that, regarding the polar resin for which "atmospheric pressure" is indicated in the column of "Pressure During Reaction", the polar resin was synthesized with a reaction system kept open to the atmosphere in a circulated state.

TABLE 1

| | Monomer Composition (parts by mass) | | | | | | | | | |
|---|---|---|---|---|---|---|---|---|---|---|
| Polar Resin | St | MMA | MAA | 2HEMA | α-ms | nBA | tBMA | Initiator | Pressure (MPa) | Temperature (° C.) |
| A1 | 91.7 | 2.5 | 3.3 | 2.5 | 0.0 | 0.0 | 0.0 | 2.0 | 0.150 | 170 |
| A2 | 57.2 | 37.0 | 3.3 | 2.5 | 0.0 | 0.0 | 0.0 | 2.0 | 0.150 | 170 |
| A3 | 61.7 | 2.5 | 3.3 | 2.5 | 30.0 | 0.0 | 0.0 | 2.0 | 0.150 | 170 |
| A4 | 86.7 | 2.5 | 3.3 | 2.5 | 0.0 | 5.0 | 0.0 | 2.0 | 0.150 | 170 |
| A5 | 88.7 | 2.5 | 3.3 | 2.5 | 0.0 | 3.0 | 0.0 | 1.5 | 0.150 | 170 |
| A6 | 86.7 | 2.5 | 3.3 | 2.5 | 5.0 | 0.0 | 0.0 | 3.0 | 0.150 | 170 |
| A7 | 54.2 | 40.0 | 3.3 | 2.5 | 0.0 | 0.0 | 0.0 | 2.0 | 0.150 | 170 |
| A8 | 81.7 | 2.5 | 3.3 | 2.5 | 0.0 | 0.0 | 10.0 | 2.0 | 0.150 | 170 |
| A9 | 44.2 | 50.0 | 3.3 | 2.5 | 0.0 | 0.0 | 0.0 | 2.0 | 0.150 | 170 |
| A10 | 71.7 | 2.5 | 3.3 | 2.5 | 0.0 | 0.0 | 20.0 | 2.0 | 0.150 | 170 |
| A11 | 91.0 | 2.5 | 4.0 | 2.5 | 0.0 | 0.0 | 0.0 | 2.0 | 0.150 | 170 |
| A12 | 93.7 | 2.5 | 1.3 | 2.5 | 0.0 | 0.0 | 0.0 | 2.0 | 0.150 | 170 |
| A13 | 90.5 | 2.5 | 4.5 | 2.5 | 0.0 | 0.0 | 0.0 | 2.0 | 0.150 | 170 |
| A14 | 93.9 | 2.5 | 1.1 | 2.5 | 0.0 | 0.0 | 0.0 | 2.0 | 0.150 | 170 |
| A15 | 93.4 | 2.5 | 1.7 | 2.5 | 0.0 | 0.0 | 0.0 | 2.0 | 0.150 | 170 |
| A16 | 88.0 | 2.5 | 3.3 | 6.3 | 0.0 | 0.0 | 0.0 | 2.0 | 0.150 | 170 |
| A17 | 92.2 | 2.5 | 3.3 | 2.0 | 0.0 | 0.0 | 0.0 | 2.0 | 0.150 | 170 |
| A18 | 87.7 | 2.5 | 3.3 | 6.5 | 0.0 | 0.0 | 0.0 | 2.0 | 0.150 | 170 |
| A19 | 92.4 | 2.5 | 3.3 | 1.8 | 0.0 | 0.0 | 0.0 | 2.0 | 0.150 | 170 |
| A20 | 95.9 | 2.5 | 1.7 | 0.0 | 0.0 | 0.0 | 0.0 | 2.0 | 0.150 | 170 |
| A21 | 15.3 | 70.0 | 1.5 | 6.3 | 0.0 | 7.0 | 0.0 | 3.0 | 0.150 | 170 |
| A22 | 91.7 | 2.5 | 3.3 | 2.5 | 0.0 | 0.0 | 0.0 | 1.5 | 0.300 | 210 |
| A23 | 91.7 | 2.5 | 3.3 | 2.5 | 0.0 | 0.0 | 0.0 | 2.1 | 0.125 | 150 |
| A24 | 91.7 | 2.5 | 3.3 | 2.5 | 0.0 | 0.0 | 0.0 | 1.2 | 0.350 | 220 |
| A25 | 91.7 | 2.5 | 3.3 | 2.5 | 0.0 | 0.0 | 0.0 | 2.2 | atmospheric pressure | 140 |
| A26 | 95.9 | 2.5 | 1.7 | 0.0 | 0.0 | 0.0 | 0.0 | 2.2 | atmospheric pressure | 140 |
| A27 | 78.4 | 20.0 | 1.7 | 0.0 | 0.0 | 0.0 | 0.0 | 2.2 | atmospheric pressure | 140 |
| A28 | 73.4 | 25.0 | 1.7 | 0.0 | 0.0 | 0.0 | 0.0 | 2.2 | atmospheric pressure | 140 |
| A29 | 55.9 | 2.5 | 1.7 | 0.0 | 40.0 | 0.0 | 0.0 | 2.2 | atmospheric pressure | 140 |
| A30 | 88.9 | 2.5 | 1.7 | 0.0 | 0.0 | 7.0 | 0.0 | 2.2 | atmospheric pressure | 140 |
| A31 | 89.9 | 2.5 | 1.7 | 0.0 | 0.0 | 6.0 | 0.0 | 2.2 | atmospheric pressure | 140 |

TABLE 1-continued

| Polar Resin | Monomer Composition (parts by mass) St | MMA | MAA | 2HEMA | α-ms | nBA | tBMA | Initiator | Pressure (MPa) | Temperature (° C.) |
|---|---|---|---|---|---|---|---|---|---|---|
| A32 | 95.9 | 2.5 | 1.7 | 0.0 | 0.0 | 0.0 | 0.0 | 1.2 | atmospheric pressure | 140 |
| A33 | 95.9 | 2.5 | 1.7 | 0.0 | 0.0 | 0.0 | 0.0 | 3.5 | atmospheric pressure | 140 |

* In "Monomer Composition", St denotes styrene, MMA denotes methyl methacrylate, MAA denotes methacrylic acid, 2HEMA denotes 2-hyroxyethyl methacrylate, α-ms denotes α-methyl styrene, nBA denotes n-butyl acrylate, tBMA denotes t-butyl methacrylate, and the initiator is di-tert-butylperoxide.

TABLE 2

| Polar Resin | δ $(cal/cm^3)^{1/2}$ | Tg (° C.) | Av (mgKOH/g) | OHv (mgKOH/g) | Mw | α/β |
|---|---|---|---|---|---|---|
| A1 | 9.06 | 92.8 | 20.3 | 10.2 | 14800 | 1.02 |
| A2 | 9.81 | 93.5 | 20.1 | 10.1 | 15200 | 0.99 |
| A3 | 9.21 | 103.8 | 20.3 | 10.3 | 14700 | 0.97 |
| A4 | 9.10 | 77.4 | 20.6 | 10.4 | 15000 | 1.03 |
| A5 | 9.08 | 93.4 | 20.5 | 10.2 | 28400 | 1.01 |
| A6 | 9.10 | 92.5 | 20.1 | 10.1 | 11000 | 1.00 |
| A7 | 9.87 | 94.1 | 19.8 | 10.3 | 15100 | 0.99 |
| A8 | 8.90 | 94.3 | 20.3 | 10.2 | 15200 | 0.96 |
| A9 | 10.07 | 94.5 | 20.1 | 10.6 | 14800 | 1.01 |
| A10 | 8.70 | 94.6 | 19.9 | 10.3 | 15300 | 0.98 |
| A11 | 9.08 | 92.9 | 24.3 | 10.1 | 15200 | 1.02 |
| A12 | 9.00 | 91.9 | 8.4 | 10.2 | 14800 | 0.97 |
| A13 | 9.10 | 92.0 | 26.7 | 10.4 | 15200 | 0.99 |
| A14 | 8.99 | 89.9 | 7.5 | 10.4 | 14900 | 0.98 |
| A15 | 9.01 | 89.3 | 10.2 | 10.1 | 15600 | 1.00 |
| A16 | 9.03 | 89.5 | 20.4 | 24.2 | 14900 | 0.98 |
| A17 | 9.07 | 91.4 | 20.2 | 8.2 | 15000 | 1.01 |
| A18 | 9.02 | 89.1 | 20.4 | 26.5 | 15200 | 1.03 |
| A19 | 9.07 | 91.5 | 20.1 | 7.5 | 15400 | 1.00 |
| A20 | 9.04 | 89.6 | 10.3 | 0.0 | 15200 | 1.02 |
| A21 | 10.38 | 74.1 | 8.3 | 24.1 | 11200 | 0.98 |
| A22 | 9.06 | 92.5 | 20.1 | 10.4 | 15100 | 1.17 |
| A23 | 9.06 | 92.7 | 20.2 | 10.5 | 15400 | 0.82 |
| A24 | 9.06 | 92.4 | 20.4 | 10.3 | 14600 | 1.25 |
| A25 | 9.06 | 92.3 | 20.1 | 10.1 | 15600 | 0.76 |
| A26 | 9.04 | 89.6 | 10.3 | 0.0 | 15200 | 0.75 |
| A27 | 9.43 | 92.0 | 10.5 | 0.0 | 14900 | 0.74 |
| A28 | 9.54 | 92.3 | 10.7 | 0.0 | 15000 | 0.76 |
| A29 | 9.10 | 109.8 | 10.5 | 0.0 | 15400 | 0.78 |
| A30 | 9.09 | 73.5 | 10.5 | 0.0 | 15300 | 0.73 |
| A31 | 9.08 | 76.2 | 10.2 | 0.0 | 15100 | 0.78 |
| A32 | 9.04 | 101.3 | 10.2 | 0.0 | 32200 | 0.74 |
| A33 | 9.04 | 84.2 | 10.4 | 0.0 | 9200 | 0.71 |

<Polar Resin B1>

The following materials;

| | |
|---|---|
| terephthalic acid | 24.0 parts by mass |
| isophthalic acid | 24.0 parts by mass |
| bisphenol A - propylene oxide 2-mol adduct | 115.2 parts by mass |
| bisphenol A - propylene oxide 3-mol adduct | 12.8 parts by mass |
| catalyst: K oxalate titanate | 0.035 parts by mass |

were put in an autoclave provided with a depressurization apparatus, a water separator, a nitrogen gas introducing apparatus, a temperature measuring device, and a stirrer. A reaction was developed for 20 hours at 220° C. in a nitrogen atmosphere under ordinary pressure, and was further continued for 1 hour under depressurization at a level of 10 to 20 mmHg. Then, the temperature was lowered to 170° C. and 0.15 part by mass of trimellitic anhydride was added. In that state, the reaction was continued for 1.0 hour at 170° C. After lowering the temperature, a polar resin B1 was obtained through pulverization. Physical properties of the polar resin B1 are listed in Table 4.

<Polar Resins B2 to B23>

Polar resins B2 to B23 were synthesized in a similar manner to that used in the above example of producing the polar resin B1 except for changing the monomer components and the catalyst as listed in Table 3. Be it noted that, in Table 3, each component ratio is represented in terms of "mol ratio".

TABLE 3

| Polar Resin | Monomer Components Acid Component Ratio TPA/IPA/FA | Diol Component Ratio BPA/BPF/BPS | Added Component Ratio EO/PO/PO2/PO3 | Reaction Catalyst | Amount of Trimellitic Acid (part by mass) | Acid/Diol Component Ratio |
|---|---|---|---|---|---|---|
| B1 | 50/50/0 | 100/0/0 | 0/0/90/10 | K oxalate titanate | 0.15 | 1/1.3 |
| B2 | 0/100/0 | 0/0/100 | 0/100/0/0 | K oxalate titanate | 0.15 | 1/1.3 |
| B3 | 100/0/0 | 100/0/0 | 0/0/30/70 | K oxalate titanate | 0.15 | 1/1.3 |
| B4 | 100/0/0 | 100/0/0 | 0/50/50/0 | K oxalate titanate | 0.15 | 1/1.3 |
| B5 | 0/100/0 | 50/50/0 | 0/0/0/100 | K oxalate titanate | 0.15 | 1/1.3 |
| B6 | 50/50/0 | 100/0/0 | 0/0/90/10 | triethanolamine titanate | 0.15 | 1/1.3 |
| B7 | 50/50/0 | 100/0/0 | 0/0/90/10 | tetrabutoxy titanate | 0.00 | 1/1 |

TABLE 3-continued

| Polar Resin | Monomer Components: Acid Component Ratio TPA/IPA/FA | Diol Component Ratio BPA/BPF/BPS | Added Component Ratio EO/PO/PO2/PO3 | Reaction Catalyst | Amount of Trimellitic Acid (part by mass) | Acid/Diol Component Ratio |
|---|---|---|---|---|---|---|
| B8 | 0/100/0 | 0/0/100 | 100/0/0/0 | K oxalate titanate | 0.15 | 1/1.3 |
| B9 | 25/25/50 | 100/0/0 | 0/0/100/0 | K oxalate titanate | 0.15 | 1/1.3 |
| B10 | 50/50/0 | 100/0/0 | 0/0/90/10 | K oxalate titanate | 0.40 | 1/1.3 |
| B11 | 50/50/0 | 100/0/0 | 0/0/90/10 | K oxalate titanate | 0.12 | 1/1.3 |
| B12 | 50/50/0 | 100/0/0 | 0/0/90/10 | K oxalate titanate | 0.45 | 1/1.3 |
| B13 | 50/50/0 | 100/0/0 | 0/0/90/10 | K oxalate titanate | 0.07 | 1/1.3 |
| B14 | 50/50/0 | 100/0/0 | 0/0/90/10 | K oxalate titanate | 0.30 | 1/1.3 |
| B15 | 50/50/0 | 100/0/0 | 0/0/90/10 | K oxalate titanate | 0.15 | 1/1.3 |
| B16 | 50/50/0 | 100/0/0 | 0/0/90/10 | triethanolamine titanate | 0.40 | 1/1.3 |
| B17 | 50/50/0 | 100/0/0 | 0/0/90/10 | K oxalate titanate | 0.40 | 1/1.3 |
| B18 | 50/50/0 | 100/0/0 | 0/0/90/10 | triethanolamine titanate | 0.15 | 1/1.3 |
| B19 | 0/0/100 | 100/0/0 | 0/50/50/0 | K oxalate titanate | 0.15 | 1/1.3 |
| B20 | 100/0/0 | 100/0/0 | 0/100/0/0 | K oxalate titanate | 0.15 | 1/1.3 |
| B21 | 0/100/0 | 50/50/0 | 0/0/100/0 | K oxalate titanate | 0.15 | 1/1.3 |
| B22 | 50/50/0 | 100/0/0 | 0/0/90/10 | triethanolamine titanate | 0.15 | 1/1.3 |
| A23 | 50/50/0 | 100/0/0 | 0/0/90/10 | tetrabutoxy titanate | 0.00 | 1/1 |

* In "Acid Component Ratio", TPA denotes terephthalic acid, IPA denotes isophthalic acid, and FA denotes fumaric acid.
In "Diol Component Ratio", BPA denotes bisphenol A, BPF denotes bisphenol F, and BPS denotes bisphenol S.
In "Added Component Ratio", EO represents 1-mol addition of ethylene oxide, and PO, PO2 and PO3 represent 1-mol addition, 2-mol addition and 3-mol addition of propylene oxide, respectively.

TABLE 4

| Polar Resin | δ $(cal/cm^3)^{1/2}$ | Tg (° C.) | Av (mgKOH/g) | OHv (mgKOH/g) | Mw |
|---|---|---|---|---|---|
| B1 | 10.38 | 74.8 | 8.2 | 24.3 | 9500 |
| B2 | 11.90 | 79.5 | 8.0 | 24.4 | 9300 |
| B3 | 10.20 | 70.4 | 8.3 | 24.1 | 9400 |
| B4 | 10.57 | 84.2 | 8.1 | 24.5 | 9500 |
| B5 | 10.26 | 66.5 | 7.6 | 25.2 | 9400 |
| B6 | 10.39 | 76.8 | 7.1 | 16.2 | 14200 |
| B7 | 10.46 | 73.1 | 19.3 | 29.3 | 5400 |
| B8 | 12.12 | 80.3 | 8.2 | 24.2 | 9500 |
| B9 | 9.87 | 67.2 | 8.3 | 23.9 | 9400 |
| B10 | 10.40 | 74.6 | 19.6 | 19.3 | 9600 |
| B11 | 10.38 | 75.1 | 6.0 | 25.8 | 9600 |
| B12 | 10.40 | 75.2 | 22.1 | 18.0 | 9300 |
| B13 | 10.37 | 74.9 | 4.3 | 27.1 | 9400 |
| B14 | 10.39 | 75.0 | 14.8 | 20.8 | 9300 |
| B15 | 10.37 | 74.3 | 7.9 | 29.5 | 8400 |
| B16 | 10.40 | 75.9 | 15.1 | 15.5 | 11800 |
| B17 | 10.37 | 74.1 | 8.1 | 31.3 | 7800 |
| B18 | 10.41 | 75.6 | 19.0 | 13.7 | 12000 |
| B19 | 9.82 | 77.2 | 20.2 | 13.1 | 12500 |
| B20 | 10.76 | 86.2 | 8.2 | 23.8 | 9200 |
| B21 | 10.39 | 63.1 | 8.1 | 24.2 | 9100 |
| B22 | 10.39 | 77.2 | 6.1 | 15.7 | 15800 |
| B23 | 10.39 | 73.2 | 21.4 | 33.1 | 4200 |

[Example of Producing Colorant Dispersed Liquid]

The following materials;

| | |
|---|---|
| styrene | 39.0 parts by mass |
| colorant C.I. Pigment Blue 15:3 | 6.5 parts by mass |

were mixed and stirred with zirconia beads (3/16 in) for 3 hours at 200 rpm (revolutions/minute) by using an attritor (made by Mitsui Mining Co., Ltd.). A colorant dispersed liquid was then obtained by separating the zirconia beads.

[Examples of Producing Toners]

<Toner 1>

The following materials;

| | |
|---|---|
| styrene | 31.0 parts by mass |
| n-butyl acrylate | 30.0 parts by mass |
| polar resin L: polar resin A1 | 15.0 parts by mass |
| polar resin H: polar resin B1 | 4.0 parts by mass |
| sulfonic group-containing copolymer FCA-1001-NS (FUJIKURA KASEI CO., LTD.) | 0.3 part by mass |
| charging control agent BONTRON E-88 (Orient Chemical Industries Co., Ltd.) | 0.5 part by mass |

were mixed and stirred for 2 hours to dissolve the polar resins in the solvent, whereby a monomer composition containing the polar resins was obtained.

The following materials;

| | |
|---|---|
| monomer composition containing the polar resins | 80.8 parts by mass |
| colorant dispersed liquid | 45.5 parts by mass |

were mixed and stirred for 30 minutes by using CAVITRON (EUROTEC, LTD.), which was installed in the circulation line, on condition that the flow rate in the inlet was set to 5 m/s, the pressure in the dispersion container was set to 100 kPa, and the circumferential speed of the rotor was set to 32 m/s. Then, the mixture was heated to 60° C., and 9.0 parts by mass of wax HNP-51 (Nippin Seiro Co., Ltd.) was added. 10.0 Parts by mass of a polymerization initiator 1,1,3,3-tetramethylbutylperoxy 2-ethylhexanoate (50% toluene solution) was further added and stirred for 5 minutes.

On the other hand, 850 parts of 0.1 mol/L-$Na_3PO_4$ aqueous solution and 8.0 parts by mass of 10%-hydrochloric acid were added into a container provided with a high-speed stirring apparatus CREAMIX (M Technique Co., Ltd.). The number of revolutions was adjusted to 80 rps, and the mixture was heated to 60° C. Further, 68 parts of 1.0-mol/L $CaCl_2$ aqueous solution were added to prepare a water-based medium containing a small amount of water-insoluble dispersant $Ca_3(PO_4)_2$. After the lapse of 5 minutes from the adding of the polymerization initiator to the polymerizable monomer composition, the polymerizable monomer composition at 60° C. was put into the water-based medium heated to 60° C., and a granulation process was continued for 15 minutes while CREAMIX was rotated at 80 rps. After replacing the high-speed stirring apparatus with propeller stirring blades, a reaction was developed for 5 hours at 70° C. under circulation and further continued for 2 hours at the liquid temperature adjusted to 80° C. After the polymerization, the liquid temperature was lowered to about 20° C., and diluted hydrochloric acid was added to adjust a pH value of the water-based medium to be 3.0 or below. The water insoluble dispersant was thereby dissolved. Toner particles were then obtained through washing and drying. The obtained toner particles were measured for the weight-average particle diameter (D4) (μm), the number-average particle diameter (D1) (μm), and the percentage (number %) of particles of 4 μm or smaller. The measured results are listed in Table 7. Thereafter, Toner 1 was obtained by adding, to 100.0 parts by mass of the toner particles, 2.0 parts by mass of hydrophobic silica fine powder (primary particle diameter: 10 nm, and BET specific surface area: 170 $m^2/g$), which was treated with dimethyl silicone oil (20% by mass) as a fluidity improver and which was triboelectrically charged in the same polarity (negative polarity) as that of the toner particles, and by mixing them for 15 minutes at 3000 rpm with a Henschel mixer (made by Mitsui Mining Co., Ltd.). As a result of measuring the amount of the polymerizable monomer in the filtrate obtained after filtration of the slurry, it was confirmed that 100.0% by mass of the added polymerizable monomer was polymerized to the binding resin. In addition, resin particles were obtained by similarly developing a polymerization reaction for the same monomer composition as that used in the above-described toner production process in a system not containing the colorant, the polar resin H, the polar resin L, the charging control agent, the sulfonic group-containing copolymer, the wax, and the fluidity improver. An SP value of the obtained resin particles was defined as the SP value δB ($(cal/cm^3)^{1/2}$) of the binding resin.

<Toner 2 to Toner 49>

Toner 2 to Toner 49 were obtained in the same manner as that in the above-described example of producing Toner 1 except for changing, in the process of producing Toner 1, the monomer composition of the binding resin and the types and the amounts of the added polar resins as listed in Tables 5 and 6. For Toner 2 to Toner 49, it was also confirmed that 100.0% by mass of the added polymerizable monomer was polymerized to the binding resin.

<Toner 50>

Toner 50 was obtained in the same manner as that in the above-described example of producing Toner 1 except for not adding, in the process of producing Toner 1, the sulfonic group-containing copolymer FCA-1001-NS. For Toner 50, it was also confirmed that 100.0% by mass of the added polymerizable monomer was polymerized to the binding resin.

<Toner 51>

Toner 51 was obtained in the same manner as that in the above-described example of producing Toner 1 except for, in the process of producing Toner 1, changing the stirring apparatus, which was installed in the circulation line, from CAVITRON (EUROTEC, LTD.) to CREAMIX W MOTION (M Technique Co., Ltd.) and setting the circumferential speed of the stirring blades to 33 m/s and the circumferential speed of the screen to 33 m/s. For Toner 51, it was also confirmed that 100.0% by mass of the added polymerizable monomer was polymerized to the binding resin.

<Toner 52>

Toner 52 was produced in the same manner as that in the above-described example of producing Toner 1 except for not performing, in the process of producing Toner 1, the stirring process with CAVITRON after mixing the polymerizable monomer containing the polar resins with the colorant dispersed liquid. For Toner 52, it was also confirmed that 100.0% by mass of the added polymerizable monomer was polymerized to the binding resin.

<Toner 53>

Dissolution and suspension type toner was produced as follows.

(Production of Wax Dispersant)

The following materials;

| | |
|---|---|
| xylene | 300.0 parts by mass |
| wax HNP-51 (Nippon Seiro Co., Ltd.) | 100.0 parts by mass |

were put in an autoclave provided with a thermometer and a stirrer and were heated to 150° C. in a nitrogen atmosphere.

Polymerization was developed by continuously dropping a mixed solution of;

| | |
|---|---|
| styrene | 100.0 parts by mass |
| acrylonitrile | 84.0 parts by mass |
| monobutyl maleate | 120.0 parts by mass |
| di-t-butylperoxyhexahydro terephthalate | 5.0 parts by mass |
| xylene | 200.0 parts by mass |

for 3 hours, and by holding the mixed solution at 150° C. for 60 minutes. After putting the polymerized product into 2000 pats by mass of methanol, the wax dispersant was obtained through filtration and drying.

(Production of Wax Dispersed Liquid)

100 Parts by mass of the wax HNP-51, pulverized into the average particle diameter of 20 μm, was mixed in 100.0 parts by mass of methanol. The mixture was stirred for 10 minutes at the number of revolutions of 150 rpm and then filtrated after washing. After repeating the above-described process three times, the mixture was filtrated and the wax was recovered through drying. 90.0 Parts by mass of the obtained wax, 10.0 parts by mass of the above-mentioned wax dispersant, and 100.0 parts by mass of ethyl acetate were put in the attritor (made by Mitsui Mining Co., Ltd.) together with zirconia beads having a diameter of 20 mm and were dispersed for 2 hours at 150 rpm. The wax dispersed liquid was then obtained by separating the zirconia beads.

(Example of Producing Colorant Dispersed Liquid)

20.0 Parts by mass of the colorant C.I. Pigment Blue and 80.0 parts by mass of ethyl acetate were put in the attritor (made by Mitsui Mining Co., Ltd.) together with zirconia beads having a diameter of 20 mm, and the attritor was rotated for 8 hours at 300 rpm. A colorant (pigment) dispersed liquid was then obtained by separating the zirconia beads.

(Production of Toners)

The following materials;

| | |
|---|---|
| binding resin: copolymer of styrene-n-butyl acrylate (copolymerization ratio of styrene to n-butyl acrylate = 70:30, Mp = 22000, Mw = 35000, Mw/Mn = 2.4, Tg = 45° C.) | 100.0 parts by mass |
| polar resin L: polar resin A26 | 15.0 parts by mass |
| polar resin H: polar resin B1 | 4.0 parts by mass |
| wax dispersed liquid | 24.0 parts by mass |
| colorant dispersed liquid | 30.0 parts by mass |
| charging control agent BONTRON E-88 (Orient Chemical Industries Co., Ltd.) | 0.5 part by mass |
| sulfonic group-containing copolymer FCA-1001-NS (FUJIKURA KASEI CO., LTD.) | 0.3 part by mass |

were homogeneously mixed to form a toner composition.

On the other hand, 850 parts by mass of 0.1 mol/L-$Na_3PO_4$ aqueous solution and 8.0 parts by mass of 10%-hydrochloric acid were added into a container provided with the high-speed stirring apparatus CREAMIX (M Technique Co., Ltd.). The number of revolutions was adjusted to 80 rps, and the mixture was heated to 60° C. Further, 68 parts by mass of 1.0-mol/L $CaCl_2$ aqueous solution were added to prepare a water-based medium containing a small amount of water-insoluble dispersant $Ca_3(PO_4)_2$. The above-obtained toner composition was put into the water-based medium and a granulation process was continued for 2 minutes while the water-based medium was held at 30 to 35° C. and the number of revolutions was maintained at 80 rps. Thereafter, 500 parts by mass of ion exchanged water were added. After replacing the high-speed stirring apparatus with an ordinary propeller stirring apparatus, the water-based medium was held at 30 to 35° C., the number of revolutions of the stirring apparatus was set to 150 rpm, and the interior of the container was depressurize to 52 kPa to fractionally remove the ethyl acetate until the residual amount is reduced to 200 ppm.

Next, the temperature of the water-based (dispersion) medium was raised to 70° C. such that and the water-based dispersion medium was heat-treated for 30 minutes at 70° C. Thereafter, the water-based dispersion medium was cooled to 25° C. at a cooling rate of 0.15° C./min. Diluted hydrochloric acid was added to the water-based dispersion medium while the medium temperature was held at 20.0 to 25.0° C. The water insoluble dispersant was thereby dissolved. Toner particles were then obtained through washing and drying. The obtained toner particles were measured for the weight-average particle diameter (D4) (μm), the number-average particle diameter (D1) (μm), and the percentage (number %) of particles of 4 μm or smaller. The measured results are listed in Table 8. Thereafter, Toner 53 was obtained by adding, to 100.0 parts by mass of the toner particles, 2.0 parts by mass of hydrophobic silica fine powder (primary particle diameter: 10 nm, and BET specific surface area: 170 $m^2/g$), which was treated with dimethyl silicone oil (20% by mass) as a fluidity improver and which was triboelectrically charged in the same polarity (negative polarity) as that of the toner particles, and by mixing them for 15 minutes at 3000 rpm with the Henschel mixer (made by Mitsui Mining Co., Ltd.). An SP value of the copolymer of styrene-n-butyl acrylate was defined as the SP value δB ($(cal/cm^3)^{1/2}$) of the binding resin.

<Toner 54 to Toner 74>

Toner 54 to Toner 74 were obtained in the same manner as that in the above-described example of producing Toner 52 except for changing, in the process of producing Toner 52, the monomer composition of the binding resin and the types and the amounts of the added polar resins as listed in Table 6. For Toner 54 to Toner 74, it was also confirmed that 100.0% by mass of the added polymerizable monomer was polymerized to the binding resin. Physical properties of Toner 54 to Toner 74 are listed in Table 8.

<Toner 75>

Emulsification and aggregation type toner was produced as follows:

(Preparation of Resin Fine-Particle Dispersed Liquid)

A water-based medium was prepared by mixing the following materials in a flask:

| | |
|---|---|
| ion exchanged water | 500.0 parts by mass |
| nonionic surfactant Nonipol 400 (Kao Corporation) | 6.0 parts by mass |
| anionic surfactant Neogen SC (Dai-ichi Kogyo Seiyaku Co., Ltd.) | 10.0 parts by mass |

A mixed solution was obtained by mixing the following materials:

| | |
|---|---|
| styrene | 70.0 parts by mass |
| n-butyl acrylate | 30.0 parts by mass |
| sulfonic group-containing copolymer FCA-1001-NS (FUJIKURA KASEI CO., LTD.) | 0.3 part by mass |
| charging control agent BONTRON E-88 (Orient Chemical Industries Co., Ltd.) | 0.5 part by mass |

The obtained mixed solution was dissolved and emulsified in the above-mentioned water-based medium, and 50 parts by mass of ion exchanged water solution, in which 4 parts by mass of ammonium persulfate, was slowly added under stirring and mixing for 10 minutes. After sufficiently replacing an atmosphere in the system with nitrogen, the temperature in the system was raised to 70° C. under stirring with the flask immersed in an oil bath, and emulsification polymerization was continued for 5 hours in such a state. As a result, anionic resin fine-particle dispersed liquid was obtained.

(Preparation of Colorant Particle Dispersed Liquid)

The following components;

| | |
|---|---|
| ion exchanged water | 100.0 parts by mass |
| colorant C.I. Pigment Blue 15:3 | 6.5 parts by mass |
| nonionic surfactant Nonipol 400 (Kao Corporation) | 1.0 part by mass |

were mixed, dissolved and dispersed for 10 minutes by using ULTRA-TURRAX T50 (IKA Co.). A colorant particle dispersed liquid was thereby obtained.

(Preparation of Releasing-Agent Particle Dispersed Liquid)

The following components;

| | |
|---|---|
| ion exchanged water | 100.0 parts by mass |
| wax HNP-51 (Nippon Seiro Co., Ltd.) | 9.0 parts by mass |
| cationic surfactant Sanisol B50 (Kao Corporation) | 5.0 part by mass |

were heated to temperature of 95° C. and were sufficiently dispersed by using ULTRA-TURRAX T50. Thereafter, the mixture was further dispersed by using a pressure discharge type homogenizer, and a releasing-agent particle dispersed liquid was obtained.

(Preparation of Shell-Forming Fine-Particle Dispersed Liquid 1)

The following components;

| | |
|---|---|
| ion exchanged water | 100.0 parts by mass |
| ethyl acetate | 50.0 parts by mass |
| polar resin L: polar resin A26 | 15.0 parts by mass |

were mixed and stirred. While continuing emulsification by using ULTRA-TURRAX T50, the obtained solution was heated to temperature of 80° C. and was held in the heated state for 6 hours to remove the solvent. A shell-forming fine-particle dispersed liquid 1 was thereby obtained.

(Preparation of Shell-Forming Fine-Particle Dispersed Liquid 2)

The following components;

| | |
|---|---|
| ion exchanged water | 100.0 parts by mass |
| ethyl acetate | 50.0 parts by mass |
| polar resin H: polar resin B1 | 4.0 parts by mass |

were mixed and stirred. While continuing emulsification by using ULTRA-TURRAX T50, the obtained solution was heated to temperature of 80° C. and was held in the heated state for 6 hours to remove the solvent. A shell-forming fine-particle dispersed liquid 2 was thereby obtained.

(Production of Toner)

The resin fine-particle dispersed liquid, the colorant particle dispersed liquid, the releasing-agent particle dispersed liquid, each prepared as described above, and 1.2 parts by mass of aluminum polychloride were sufficiently mixed and dispersed in a round stainless-made flask by using ULTRA-TURRAX T50, and then heated to temperature of 51° C. under stirring with the flask immersed in a heating oil bath. After holding the mixture at the temperature of 51° C. for 60 minutes, the shell-forming fine-particle dispersed liquid 1 and the shell-forming fine-particle dispersed liquid 2 were added thereto. A pH value in the system was adjusted to 6.5 by using a sodium hydroxide aqueous solution with concentration of 0.5 mol/L. After tightly closing the stainless-made flask, the mixture was heated to temperature of 97° C. and was held for 3 hours with a stirring shaft maintained in a magnetically shielded state, while the stirring was continued.

After the reaction, the mixture was cooled, filtrated, and sufficiently washed with ion exchanged water. The mixture was then separated into solid and liquid components by using a Nutsche type suction filtration. The obtained solid component was dispersed again by using 3 L of ion exchanged water at temperature of 40° C. and was stirred for 15 minutes at 300 rpm for washing. Such a washing operation was further repeated five times. Thereafter, the solid-liquid separation was performed with the Nutsche type suction filtration by using No. 5A filter paper. The obtained solid component was then vacuum-dried continuously for 12 hours, whereby toner particles were obtained. The obtained toner particles were measured for the weight-average particle diameter (D4) (μm), the number-average particle diameter (D1) (μm), and the percentage (number %) of particles of 4 μm or smaller. The measured results are listed in Table 8. Thereafter, Toner 75 was obtained by adding, to 100.0 parts by mass of the toner particles, 2.0 parts by mass of hydrophobic silica fine powder (primary particle diameter: 10 nm, and BET specific surface area: 170 $m^2/g$), which was treated with dimethyl silicone oil (20% by mass) as a fluidity improver and which was triboelectrically charged in the same polarity (negative polarity) as that of the toner particles, and by mixing them for 15 minutes at 3000 rpm with the Henschel mixer (made by Mitsui Mining Co., Ltd.).

<Toner 76>

Pulverization type toner was produced as follows.

The following materials:

| | |
|---|---|
| binding resin: copolymer of styrene-n-butyl acrylate (copolymerization ratio of styrene to n-butyl acrylate = 70:30, Mp = 22000, Mw = 35000, Mw/Mn = 2.4, Tg = 45° C.) | 100.0 parts by mass |
| sulfonic group-containing copolymer FCA-1001-NS (FUJIKURA KASEI CO., LTD.) | 0.3 part by mass |
| colorant C.I. Pigment Blue 15:3 | 6.5 parts by mass |
| charging control agent BONTRON E-88 (Orient Chemical Industries Co., Ltd.) | 0.5 part by mass |
| wax HNP-51 (Nippon Seiro Co., Ltd.) | 9.0 parts by mass |

were dissolved, kneaded, and pulverized. Further, 15 parts by mass of resin fine particles (number-average particle diameter: 300 nm) of the polar resin A26 were added and processed by using a hybridization system (made by NARA MACHINERY CO., LTD.). Still further, 4.0 parts by mass of resin fine particles (number-average particle diameter: 300 nm) of the polar resin B1 were added and processed by using the hybridization system, whereby toner particles were obtained. Toner 76 was obtained by adding, to 100.0 parts by mass of the toner particles, 2.0 parts by mass of hydrophobic silica fine powder (primary particle diameter: 10 nm, and BET specific surface area: 170 $m^2/g$), which was treated with dimethyl silicone oil (20% by mass) as a fluidity improver and which was triboelectrically charged in the same polarity (negative polarity) as that of the toner particles, and by mixing them for 15 minutes at 3000 rpm with the Henschel mixer (made by Mitsui Mining Co., Ltd.).

Physical properties of Toners 1 to 76 are listed in Tables 7 and 8.

TABLE 5

| | Binding Resin Monomer Composition (parts by mass) | | | | | Polar Resin H | | Polar Resin L | | Sulfonic Group- | | |
|---|---|---|---|---|---|---|---|---|---|---|---|---|
| Toner | St | nBA | MMA | EHMA | MAA | Polar Resin | Parts Added | Polar Resin | Parts Added | Containing Resin | Production Method | Stirring Apparatus |
| 1 | 70.0 | 30.0 | 0.0 | 0.0 | 0.0 | B1 | 4.0 | A1 | 15.0 | FCA-1001-NS | suspension polymerization | CV |
| 2 | 60.0 | 30.0 | 10.0 | 0.0 | 0.0 | B1 | 4.0 | A1 | 15.0 | FCA-1001-NS | suspension polymerization | CV |
| 3 | 50.0 | 0.0 | 0.0 | 50.0 | 0.0 | B1 | 4.0 | A1 | 15.0 | FCA-1001-NS | suspension polymerization | CV |
| 4 | 70.0 | 30.0 | 0.0 | 0.0 | 0.0 | B2 | 4.0 | A1 | 15.0 | FCA-1001-NS | suspension polymerization | CV |
| 5 | 70.0 | 30.0 | 0.0 | 0.0 | 0.0 | B3 | 4.0 | A1 | 15.0 | FCA-1001-NS | suspension polymerization | CV |
| 6 | 70.0 | 30.0 | 0.0 | 0.0 | 0.0 | B1 | 4.0 | A2 | 15.0 | FCA-1001-NS | suspension polymerization | CV |
| 7 | 70.0 | 30.0 | 0.0 | 0.0 | 0.0 | B4 | 4.0 | A1 | 15.0 | FCA-1001-NS | suspension polymerization | CV |
| 8 | 70.0 | 30.0 | 0.0 | 0.0 | 0.0 | B5 | 4.0 | A1 | 15.0 | FCA-1001-NS | suspension polymerization | CV |
| 9 | 70.0 | 30.0 | 0.0 | 0.0 | 0.0 | B1 | 4.0 | A3 | 15.0 | FCA-1001-NS | suspension polymerization | CV |
| 10 | 70.0 | 30.0 | 0.0 | 0.0 | 0.0 | B1 | 4.0 | A4 | 15.0 | FCA-1001-NS | suspension polymerization | CV |
| 11 | 70.0 | 30.0 | 0.0 | 0.0 | 0.0 | B6 | 4.0 | A1 | 15.0 | FCA-1001-NS | suspension polymerization | CV |
| 12 | 70.0 | 30.0 | 0.0 | 0.0 | 0.0 | B7 | 4.0 | A1 | 15.0 | FCA-1001-NS | suspension polymerization | CV |
| 13 | 70.0 | 30.0 | 0.0 | 0.0 | 0.0 | B1 | 4.0 | A5 | 15.0 | FCA-1001-NS | suspension polymerization | CV |
| 14 | 70.0 | 30.0 | 0.0 | 0.0 | 0.0 | B1 | 4.0 | A6 | 15.0 | FCA-1001-NS | suspension polymerization | CV |
| 15 | 70.0 | 30.0 | 0.0 | 0.0 | 0.0 | B1 | 9.0 | A1 | 15.0 | FCA-1001-NS | suspension polymerization | CV |
| 16 | 70.0 | 30.0 | 0.0 | 0.0 | 0.0 | B1 | 1.5 | A1 | 15.0 | FCA-1001-NS | suspension polymerization | CV |
| 17 | 70.0 | 30.0 | 0.0 | 0.0 | 0.0 | B1 | 4.0 | A1 | 24.0 | FCA-1001-NS | suspension polymerization | CV |
| 18 | 70.0 | 30.0 | 0.0 | 0.0 | 0.0 | B1 | 4.0 | A1 | 6.0 | FCA-1001-NS | suspension polymerization | CV |
| 19 | 60.0 | 30.0 | 10.0 | 0.0 | 0.0 | B8 | 4.0 | A1 | 15.0 | FCA-1001-NS | suspension polymerization | CV |
| 20 | 50.0 | 0.0 | 0.0 | 50.0 | 0.0 | B9 | 4.0 | A1 | 15.0 | FCA-1001-NS | suspension polymerization | CV |
| 21 | 63.0 | 30.0 | 7.0 | 0.0 | 0.0 | B1 | 4.0 | A7 | 15.0 | FCA-1001-NS | suspension polymerization | CV |
| 22 | 70.0 | 30.0 | 0.0 | 0.0 | 0.0 | B1 | 4.0 | A8 | 15.0 | FCA-1001-NS | suspension polymerization | CV |
| 23 | 58.0 | 30.0 | 12.0 | 0.0 | 0.0 | B2 | 4.0 | A4 | 15.0 | FCA-1001-NS | suspension polymerization | CV |
| 24 | 70.0 | 30.0 | 0.0 | 0.0 | 0.0 | B1 | 4.0 | A9 | 15.0 | FCA-1001-NS | suspension polymerization | CV |
| 25 | 69.7 | 30.0 | 0.0 | 0.0 | 0.4 | B1 | 4.0 | A10 | 15.0 | FCA-1001-NS | suspension polymerization | CV |
| 26 | 70.0 | 30.0 | 0.0 | 0.0 | 0.0 | B10 | 4.0 | A1 | 15.0 | FCA-1001-NS | suspension polymerization | CV |
| 27 | 70.0 | 30.0 | 0.0 | 0.0 | 0.0 | B11 | 4.0 | A1 | 15.0 | FCA-1001-NS | suspension polymerization | CV |
| 28 | 70.0 | 30.0 | 0.0 | 0.0 | 0.0 | B12 | 4.0 | A1 | 15.0 | FCA-1001-NS | suspension polymerization | CV |
| 29 | 70.0 | 30.0 | 0.0 | 0.0 | 0.0 | B13 | 4.0 | A1 | 15.0 | FCA-1001-NS | suspension polymerization | CV |
| 30 | 70.0 | 30.0 | 0.0 | 0.0 | 0.0 | B1 | 4.0 | A11 | 15.0 | FCA-1001-NS | suspension polymerization | CV |
| 31 | 70.0 | 30.0 | 0.0 | 0.0 | 0.0 | B1 | 4.0 | A12 | 15.0 | FCA-1001-NS | suspension polymerization | CV |
| 32 | 70.0 | 30.0 | 0.0 | 0.0 | 0.0 | B1 | 4.0 | A13 | 15.0 | FCA-1001-NS | suspension polymerization | CV |
| 33 | 70.0 | 30.0 | 0.0 | 0.0 | 0.0 | B1 | 4.0 | A14 | 15.0 | FCA-1001-NS | suspension polymerization | CV |
| 34 | 70.0 | 30.0 | 0.0 | 0.0 | 0.0 | B14 | 4.0 | A15 | 15.0 | FCA-1001-NS | suspension polymerization | CV |
| 35 | 70.0 | 30.0 | 0.0 | 0.0 | 0.0 | B15 | 4.0 | A1 | 15.0 | FCA-1001-NS | suspension polymerization | CV |

TABLE 5-continued

| | Binding Resin Monomer Composition (parts by mass) | | | | | Polar Resin H | | Polar Resin L | | Sulfonic Group- | | |
|---|---|---|---|---|---|---|---|---|---|---|---|---|
| Toner | St | nBA | MMA | EHMA | MAA | Polar Resin | Parts Added | Polar Resin | Parts Added | Containing Resin | Production Method | Stirring Apparatus |
| 36 | 70.0 | 30.0 | 0.0 | 0.0 | 0.0 | B16 | 4.0 | A1 | 15.0 | FCA-1001-NS | suspension polymerization | CV |
| 37 | 70.0 | 30.0 | 0.0 | 0.0 | 0.0 | B17 | 4.0 | A1 | 15.0 | FCA-1001-NS | suspension polymerization | CV |
| 38 | 70.0 | 30.0 | 0.0 | 0.0 | 0.0 | B18 | 4.0 | A1 | 15.0 | FCA-1001-NS | suspension polymerization | CV |
| 39 | 70.0 | 30.0 | 0.0 | 0.0 | 0.0 | B1 | 4.0 | A16 | 15.0 | FCA-1001-NS | suspension polymerization | CV |
| 40 | 70.0 | 30.0 | 0.0 | 0.0 | 0.0 | B1 | 4.0 | A17 | 15.0 | FCA-1001-NS | suspension polymerization | CV |

* In Table, St denotes styrene, nBA denotes n-butyl acrylate, MMA denotes methyl methacrylate, EHMA denotes 2-ethylhexyl methacrylate, and MAA denotes methacrylic acid.
Further, CM denotes CAVITRON.

TABLE 6

| | Binding Resin Monomer Composition (parts by mass) | | | | | Polar Resin H | | Polar Resin L | | Sulfonic Group- | | |
|---|---|---|---|---|---|---|---|---|---|---|---|---|
| Toner | St | nBA | MMA | EHMA | MAA | Polar Resin | Parts Added | Polar Resin | Parts Added | Containing Resin | Production Method | Stirring Apparatus |
| 41 | 70.0 | 30.0 | 0.0 | 0.0 | 0.0 | B1 | 4.0 | A18 | 15.0 | FCA-1001-NS | suspension polymerization | CV |
| 42 | 70.0 | 30.0 | 0.0 | 0.0 | 0.0 | B1 | 4.0 | A19 | 15.0 | FCA-1001-NS | suspension polymerization | CV |
| 43 | 70.0 | 30.0 | 0.0 | 0.0 | 0.0 | B1 | 4.0 | A20 | 15.0 | FCA-1001-NS | suspension polymerization | CV |
| 44 | 70.0 | 30.0 | 0.0 | 0.0 | 0.0 | A21 | 4.0 | A1 | 15.0 | FCA-1001-NS | suspension polymerization | CV |
| 45 | 70.0 | 30.0 | 0.0 | 0.0 | 0.0 | B1 | 4.0 | B19 | 15.0 | FCA-1001-NS | suspension polymerization | CV |
| 46 | 70.0 | 30.0 | 0.0 | 0.0 | 0.0 | B1 | 4.0 | A22 | 15.0 | FCA-1001-NS | suspension polymerization | CV |
| 47 | 70.0 | 30.0 | 0.0 | 0.0 | 0.0 | B1 | 4.0 | A23 | 15.0 | FCA-1001-NS | suspension polymerization | CV |
| 48 | 70.0 | 30.0 | 0.0 | 0.0 | 0.0 | B1 | 4.0 | A24 | 15.0 | FCA-1001-NS | suspension polymerization | CV |
| 49 | 70.0 | 30.0 | 0.0 | 0.0 | 0.0 | B1 | 4.0 | A25 | 15.0 | FCA-1001-NS | suspension polymerization | CV |
| 50 | 70.0 | 30.0 | 0.0 | 0.0 | 0.0 | B1 | 4.0 | A1 | 15.0 | — | suspension polymerization | CV |
| 51 | 70.0 | 30.0 | 0.0 | 0.0 | 0.0 | B1 | 4.0 | A1 | 15.0 | FCA-1001-NS | suspension polymerization | WM |
| 52 | 70.0 | 30.0 | 0.0 | 0.0 | 0.0 | B1 | 4.0 | A1 | 15.0 | FCA-1001-NS | suspension polymerization | — |
| 53 | 70.0 | 30.0 | 0.0 | 0.0 | 0.0 | B1 | 4.0 | A1 | 15.0 | FCA-1001-NS | dissolution suspension | — |
| 54 | 70.0 | 30.0 | 0.0 | 0.0 | 0.0 | B1 | 4.0 | A26 | 15.0 | FCA-1001-NS | suspension polymerization | — |
| 55 | 70.0 | 30.0 | 0.0 | 0.0 | 0.0 | — | — | A1 | 20.0 | FCA-1001-NS | suspension polymerization | — |
| 56 | 70.0 | 30.0 | 0.0 | 0.0 | 0.0 | B1 | 20.0 | — | — | FCA-1001-NS | suspension polymerization | — |
| 57 | 50.0 | 30.0 | 20.0 | 0.0 | 0.0 | B1 | 4.0 | A27 | 15.0 | FCA-1001-NS | suspension polymerization | — |
| 58 | 40.0 | 0.0 | 0.0 | 60.0 | 0.0 | B1 | 4.0 | A26 | 15.0 | FCA-1001-NS | suspension polymerization | — |
| 59 | 50.0 | 0.0 | 0.0 | 50.0 | 0.0 | B2 | 4.0 | A26 | 15.0 | FCA-1001-NS | suspension polymerization | — |
| 60 | 58.0 | 30.0 | 12.0 | 0.0 | 0.0 | B3 | 4.0 | A26 | 15.0 | FCA-1001-NS | suspension polymerization | — |
| 61 | 50.0 | 0.0 | 0.0 | 50.0 | 0.0 | B3 | 4.0 | A28 | 15.0 | FCA-1001-NS | suspension polymerization | — |
| 62 | 70.0 | 30.0 | 0.0 | 0.0 | 0.0 | B20 | 4.0 | A26 | 15.0 | FCA-1001-NS | suspension polymerization | — |
| 63 | 70.0 | 30.0 | 0.0 | 0.0 | 0.0 | B21 | 4.0 | A26 | 15.0 | FCA-1001-NS | suspension polymerization | — |
| 64 | 70.0 | 30.0 | 0.0 | 0.0 | 0.0 | B1 | 4.0 | A29 | 15.0 | FCA-1001-NS | suspension polymerization | — |

TABLE 6-continued

| Toner | Binding Resin Monomer Composition (parts by mass) St | nBA | MMA | EHMA | MAA | Polar Resin H Polar Resin | Parts Added | Polar Resin L Polar Resin | Parts Added | Sulfonic Group-Containing Resin | Production Method | Stirring Apparatus |
|---|---|---|---|---|---|---|---|---|---|---|---|---|
| 65 | 70.0 | 30.0 | 0.0 | 0.0 | 0.0 | B1 | 4.0 | A30 | 15.0 | FCA-1001-NS | suspension polymerization | — |
| 66 | 70.0 | 30.0 | 0.0 | 0.0 | 0.0 | B4 | 4.0 | A31 | 15.0 | FCA-1001-NS | suspension polymerization | — |
| 67 | 70.0 | 30.0 | 0.0 | 0.0 | 0.0 | B22 | 4.0 | A26 | 15.0 | FCA-1001-NS | suspension polymerization | — |
| 68 | 70.0 | 30.0 | 0.0 | 0.0 | 0.0 | B23 | 4.0 | A26 | 15.0 | FCA-1001-NS | suspension polymerization | — |
| 69 | 70.0 | 30.0 | 0.0 | 0.0 | 0.0 | B1 | 4.0 | A32 | 15.0 | FCA-1001-NS | suspension polymerization | — |
| 70 | 70.0 | 30.0 | 0.0 | 0.0 | 0.0 | B1 | 4.0 | A33 | 15.0 | FCA-1001-NS | suspension polymerization | — |
| 71 | 70.0 | 30.0 | 0.0 | 0.0 | 0.0 | B1 | 12.0 | A26 | 15.0 | FCA-1001-NS | suspension polymerization | — |
| 72 | 70.0 | 30.0 | 0.0 | 0.0 | 0.0 | B1 | 0.5 | A26 | 15.0 | FCA-1001-NS | suspension polymerization | — |
| 73 | 70.0 | 30.0 | 0.0 | 0.0 | 0.0 | B1 | 4.0 | A26 | 27.0 | FCA-1001-NS | suspension polymerization | — |
| 74 | 70.0 | 30.0 | 0.0 | 0.0 | 0.0 | B1 | 4.0 | A26 | 4.0 | FCA-1001-NS | suspension polymerization | — |
| 75 | 70.0 | 30.0 | 0.0 | 0.0 | 0.0 | B1 | 4.0 | A26 | 15.0 | FCA-1001-NS | emulsification aggregation | — |
| 76 | 70.0 | 30.0 | 0.0 | 0.0 | 0.0 | B1 | 4.0 | A26 | 15.0 | FCA-1001-NS | pulverization | — |

* In Table, St denotes styrene, nBA denotes n-butyl acrylate, MMA denotes methyl methacrylate, EHMA denotes 2-ethylhexyl methacrylate, and MAA denotes methacrylic acid.
Further, CM denotes CAVITRON, and WM denotes CREAMIX W MOTION.

TABLE 7

| Toner | δB | δH | δL | δH − δB | \|δL − δB\| | TgH (° C.) | TgL (° C.) | MwH | MwL | AvB | AvH | AvL | OHvH | OHvL | Toner Particles D4 (μm) | D4/D1 | Percentage of particles of 4 μm or smaller (number %) |
|---|---|---|---|---|---|---|---|---|---|---|---|---|---|---|---|---|---|
| 1 | 9.15 | 10.38 | 9.06 | 1.23 | 0.09 | 74.8 | 92.8 | 9500 | 14800 | 0.0 | 8.2 | 20.3 | 24.3 | 10.2 | 6.02 | 1.15 | 17.4 |
| 2 | 9.36 | 10.38 | 9.06 | 1.02 | 0.30 | 74.8 | 92.8 | 9500 | 14800 | 0.0 | 8.2 | 20.3 | 24.3 | 10.2 | 5.96 | 1.19 | 21.8 |
| 3 | 8.82 | 10.38 | 9.06 | 1.56 | 0.24 | 74.8 | 92.8 | 9500 | 14800 | 0.0 | 8.2 | 20.3 | 24.3 | 10.2 | 6.10 | 1.15 | 16.8 |
| 4 | 9.15 | 11.90 | 9.06 | 2.75 | 0.09 | 79.5 | 92.8 | 9300 | 14800 | 0.0 | 8.0 | 20.3 | 24.4 | 10.2 | 5.94 | 1.24 | 26.2 |
| 5 | 9.15 | 10.20 | 9.06 | 1.05 | 0.09 | 70.4 | 92.8 | 9400 | 14800 | 0.0 | 8.3 | 20.3 | 24.1 | 10.2 | 6.41 | 1.25 | 17.8 |
| 6 | 9.15 | 10.38 | 9.81 | 1.23 | 0.66 | 74.8 | 93.5 | 9500 | 15000 | 0.0 | 8.2 | 20.1 | 24.3 | 10.1 | 6.05 | 1.17 | 17.8 |
| 7 | 9.15 | 10.57 | 9.06 | 1.42 | 0.09 | 84.2 | 92.8 | 9500 | 15000 | 0.0 | 8.1 | 20.3 | 24.5 | 10.2 | 6.00 | 1.16 | 18.2 |
| 8 | 9.15 | 10.26 | 9.06 | 1.11 | 0.09 | 66.5 | 92.8 | 9400 | 15000 | 0.0 | 7.6 | 20.3 | 25.2 | 10.2 | 5.97 | 1.19 | 18.5 |
| 9 | 9.15 | 10.38 | 9.21 | 1.23 | 0.06 | 74.8 | 103.8 | 9500 | 15000 | 0.0 | 8.2 | 20.3 | 24.3 | 10.3 | 6.12 | 1.15 | 17.1 |
| 10 | 9.15 | 10.38 | 9.10 | 1.23 | 0.05 | 74.8 | 77.4 | 9500 | 15000 | 0.0 | 8.2 | 20.6 | 24.3 | 10.4 | 5.88 | 1.18 | 18.9 |
| 11 | 9.15 | 10.39 | 9.06 | 1.24 | 0.09 | 76.8 | 92.8 | 14200 | 15000 | 0.0 | 7.1 | 20.3 | 16.2 | 10.2 | 6.45 | 1.24 | 17.5 |
| 12 | 9.15 | 10.46 | 9.06 | 1.31 | 0.09 | 73.1 | 92.8 | 5400 | 15000 | 0.0 | 19.3 | 20.3 | 29.3 | 10.2 | 6.10 | 1.14 | 17.2 |
| 13 | 9.15 | 10.38 | 9.08 | 1.23 | 0.07 | 74.8 | 93.4 | 9500 | 28400 | 0.0 | 8.2 | 20.5 | 24.3 | 10.2 | 6.75 | 1.26 | 17.9 |
| 14 | 9.15 | 10.38 | 9.10 | 1.23 | 0.05 | 74.8 | 92.5 | 9500 | 11000 | 0.0 | 8.2 | 20.1 | 24.3 | 10.1 | 6.04 | 1.16 | 17.2 |
| 15 | 9.15 | 10.38 | 9.06 | 1.23 | 0.09 | 74.8 | 92.8 | 9500 | 14800 | 0.0 | 8.2 | 20.3 | 24.3 | 10.2 | 6.78 | 1.31 | 18.2 |
| 16 | 9.15 | 10.38 | 9.06 | 1.23 | 0.09 | 74.8 | 92.8 | 9500 | 14800 | 0.0 | 8.2 | 20.3 | 24.3 | 10.2 | 6.02 | 1.13 | 17.5 |
| 17 | 9.15 | 10.38 | 9.06 | 1.23 | 0.09 | 74.8 | 92.8 | 9500 | 14800 | 0.0 | 8.2 | 20.3 | 24.3 | 10.2 | 6.51 | 1.32 | 18.3 |
| 18 | 9.15 | 10.38 | 9.06 | 1.23 | 0.09 | 74.8 | 92.8 | 9500 | 14800 | 0.0 | 8.2 | 20.3 | 24.3 | 10.2 | 6.20 | 1.14 | 16.2 |
| 19 | 9.36 | 12.12 | 9.06 | 2.76 | 0.30 | 80.3 | 92.8 | 9500 | 14800 | 0.0 | 8.2 | 20.3 | 24.2 | 10.2 | 6.11 | 1.32 | 29.1 |
| 20 | 8.82 | 9.87 | 9.06 | 1.05 | 0.24 | 67.2 | 92.8 | 9400 | 14800 | 0.0 | 8.3 | 20.3 | 23.9 | 10.2 | 6.82 | 1.33 | 18.4 |
| 21 | 9.30 | 10.38 | 9.87 | 1.08 | 0.57 | 74.8 | 94.1 | 9500 | 15100 | 0.0 | 8.2 | 19.8 | 24.3 | 10.3 | 6.10 | 1.17 | 16.8 |
| 22 | 9.15 | 10.38 | 8.90 | 1.23 | 0.25 | 74.8 | 94.3 | 9500 | 15200 | 0.0 | 8.2 | 20.3 | 24.3 | 10.2 | 6.02 | 1.16 | 17.2 |
| 23 | 9.41 | 11.90 | 10.07 | 2.49 | 0.66 | 74.8 | 94.5 | 9300 | 14800 | 0.0 | 8.0 | 20.1 | 24.4 | 10.6 | 5.98 | 1.25 | 22.9 |
| 24 | 9.15 | 10.38 | 8.70 | 1.23 | 0.45 | 74.8 | 94.6 | 9500 | 15300 | 0.0 | 8.2 | 19.9 | 24.3 | 10.3 | 6.48 | 1.27 | 17.3 |
| 25 | 9.15 | 10.38 | 9.06 | 1.23 | 0.09 | 74.8 | 92.8 | 9500 | 15200 | 2.5 | 8.2 | 20.3 | 24.3 | 10.2 | 5.81 | 1.19 | 22.1 |
| 26 | 9.15 | 10.40 | 9.06 | 1.25 | 0.09 | 74.6 | 92.8 | 9600 | 14800 | 0.0 | 19.6 | 20.3 | 19.3 | 10.2 | 5.92 | 1.26 | 26.1 |
| 27 | 9.15 | 10.38 | 9.06 | 1.23 | 0.09 | 75.1 | 92.8 | 9600 | 14800 | 0.0 | 6.0 | 20.3 | 25.8 | 10.2 | 6.10 | 1.25 | 18.5 |
| 28 | 9.15 | 10.40 | 9.06 | 1.25 | 0.09 | 75.2 | 92.8 | 9300 | 14800 | 0.0 | 22.1 | 20.3 | 18.0 | 10.2 | 6.05 | 1.29 | 29.3 |
| 29 | 9.15 | 10.37 | 9.06 | 1.22 | 0.09 | 74.9 | 92.8 | 9400 | 14800 | 0.0 | 4.3 | 20.3 | 27.1 | 10.2 | 6.02 | 1.31 | 20.1 |
| 30 | 9.15 | 10.38 | 9.08 | 1.23 | 0.07 | 74.8 | 92.9 | 9500 | 15200 | 0.0 | 8.2 | 24.3 | 24.3 | 10.1 | 5.92 | 1.20 | 21.0 |
| 31 | 9.15 | 10.38 | 9.00 | 1.23 | 0.15 | 74.8 | 91.9 | 9500 | 14800 | 0.0 | 8.2 | 8.4 | 24.3 | 10.2 | 6.01 | 1.14 | 17.4 |
| 32 | 9.15 | 10.38 | 9.10 | 1.23 | 0.05 | 74.8 | 92.0 | 9500 | 15200 | 0.0 | 8.2 | 26.7 | 24.3 | 10.4 | 5.88 | 1.20 | 24.0 |
| 33 | 9.15 | 10.38 | 8.99 | 1.23 | 0.16 | 74.8 | 89.9 | 9500 | 14900 | 0.0 | 8.2 | 7.5 | 24.3 | 10.4 | 6.08 | 1.25 | 18.1 |
| 34 | 9.15 | 10.39 | 9.01 | 1.24 | 0.14 | 75.0 | 89.3 | 9300 | 15600 | 0.0 | 14.8 | 10.2 | 20.8 | 10.1 | 6.02 | 1.17 | 17.3 |

TABLE 7-continued

| Toner | δB | δH | δL | δH − δB | \|δL − δB\| | TgH (° C.) | TgL (° C.) | MwH | MwL | AvB | AvH | AvL | OHvH | OHvL | Toner Particles D4 (μm) | Toner Particles D4/D1 | Toner Particles Percentage of particles of 4 μm or smaller (number %) |
|---|---|---|---|---|---|---|---|---|---|---|---|---|---|---|---|---|---|
| 35 | 9.15 | 10.37 | 9.06 | 1.22 | 0.09 | 74.3 | 92.8 | 8400 | 14800 | 0.0 | 7.9 | 20.3 | 29.5 | 10.2 | 5.86 | 1.18 | 20.5 |
| 36 | 9.15 | 10.40 | 9.06 | 1.25 | 0.09 | 75.9 | 92.8 | 11800 | 14800 | 0.0 | 15.1 | 20.3 | 15.5 | 10.2 | 5.91 | 1.16 | 19.1 |
| 37 | 9.15 | 10.37 | 9.06 | 1.22 | 0.09 | 74.1 | 92.8 | 7800 | 14800 | 0.0 | 8.1 | 20.3 | 31.3 | 10.2 | 5.82 | 1.19 | 24.1 |
| 38 | 9.15 | 10.41 | 9.06 | 1.26 | 0.09 | 75.6 | 92.8 | 12000 | 14800 | 0.0 | 19.0 | 20.3 | 13.7 | 10.2 | 6.13 | 1.24 | 17.9 |
| 39 | 9.15 | 10.38 | 9.03 | 1.23 | 0.12 | 74.8 | 89.5 | 9500 | 14900 | 0.0 | 8.2 | 20.4 | 24.3 | 24.2 | 6.07 | 1.16 | 17.8 |
| 40 | 9.15 | 10.38 | 9.07 | 1.23 | 0.08 | 74.8 | 91.4 | 9500 | 15000 | 0.0 | 8.2 | 20.2 | 24.3 | 8.2 | 6.06 | 1.14 | 17.2 |

(*) Units of δB, δH, δL, δH − δB, and |δL − δB| are each $(cal/cm^3)^{1/2}$ Units of AvB, AvH, AvL, OHvH, and OHvL are each (mgKOH/g)

TABLE 8

| Toner | δB | δH | δL | δH − δB | \|δL − δB\| | TgH (° C.) | TgL (° C.) | MwH | MwL | AvB | AvH | AvL | OHvH | OHvL | Toner Particles D4 (μm) | Toner Particles D4/D1 | Toner Particles Percentage of particles of 4 μm or smaller (number %) |
|---|---|---|---|---|---|---|---|---|---|---|---|---|---|---|---|---|---|
| 41 | 9.15 | 10.38 | 9.02 | 1.23 | 0.13 | 74.8 | 89.1 | 9500 | 15200 | 0.0 | 8.2 | 20.4 | 24.3 | 26.5 | 6.04 | 1.13 | 20.9 |
| 42 | 9.15 | 10.38 | 9.07 | 1.23 | 0.08 | 74.8 | 91.5 | 9500 | 15400 | 0.0 | 8.2 | 20.1 | 24.3 | 7.5 | 6.10 | 1.14 | 17.1 |
| 43 | 9.15 | 10.38 | 9.04 | 1.23 | 0.11 | 74.8 | 89.6 | 9500 | 15200 | 0.0 | 8.2 | 10.3 | 24.3 | 0.0 | 6.07 | 1.21 | 19.1 |
| 44 | 9.15 | 10.38 | 9.06 | 1.23 | 0.09 | 74.1 | 92.8 | 11200 | 14800 | 0.0 | 8.3 | 20.3 | 24.1 | 10.2 | 6.04 | 1.25 | 23.0 |
| 45 | 9.15 | 10.38 | 9.82 | 1.23 | 0.67 | 74.8 | 77.2 | 9500 | 12000 | 0.0 | 8.2 | 20.2 | 24.3 | 13.1 | 6.49 | 1.18 | 17.1 |
| 46 | 9.15 | 10.38 | 9.06 | 1.23 | 0.09 | 74.8 | 92.5 | 9500 | 15100 | 0.0 | 8.2 | 20.1 | 24.3 | 10.4 | 6.02 | 1.18 | 17.3 |
| 47 | 9.15 | 10.38 | 9.06 | 1.23 | 0.09 | 74.8 | 92.7 | 9500 | 15400 | 0.0 | 8.2 | 20.2 | 24.3 | 10.5 | 6.07 | 1.17 | 17.5 |
| 48 | 9.15 | 10.38 | 9.06 | 1.23 | 0.09 | 74.8 | 92.4 | 9500 | 14600 | 0.0 | 8.2 | 20.4 | 24.3 | 10.3 | 6.18 | 1.18 | 17.9 |
| 49 | 9.15 | 10.38 | 9.06 | 1.23 | 0.09 | 74.8 | 92.3 | 9500 | 15600 | 0.0 | 8.2 | 20.1 | 24.3 | 10.1 | 6.20 | 1.16 | 17.4 |
| 50 | 9.15 | 10.38 | 9.06 | 1.23 | 0.09 | 74.8 | 92.8 | 9500 | 14800 | 0.0 | 8.2 | 20.3 | 24.3 | 10.2 | 6.72 | 1.29 | 21.2 |
| 51 | 9.15 | 10.38 | 9.06 | 1.23 | 0.09 | 74.8 | 92.8 | 9500 | 14800 | 0.0 | 8.2 | 20.3 | 24.3 | 10.2 | 6.02 | 1.18 | 17.6 |
| 52 | 9.15 | 10.38 | 9.06 | 1.23 | 0.09 | 74.8 | 92.8 | 9500 | 14800 | 0.0 | 8.2 | 20.3 | 24.3 | 10.2 | 6.20 | 1.23 | 22.1 |
| 53 | 9.15 | 10.38 | 9.06 | 1.23 | 0.09 | 74.8 | 92.8 | 9500 | 14800 | 0.0 | 8.2 | 20.3 | 24.3 | 10.2 | 6.92 | 1.28 | 29.1 |
| 54 | 9.15 | 10.38 | 9.04 | 1.23 | 0.11 | 74.8 | 89.6 | 9500 | 15200 | 0.0 | 8.2 | 10.3 | 25.0 | 0.0 | 6.21 | 1.24 | 20.3 |
| 55 | 9.15 | — | 9.06 | — | — | — | — | — | — | — | — | — | — | — | 6.31 | 1.20 | 18.5 |
| 56 | 9.15 | — | — | — | — | — | — | — | — | — | — | — | — | — | 5.86 | 1.14 | 17.3 |
| 57 | 9.58 | 10.38 | 9.43 | 0.80 | 0.15 | 74.8 | 92.0 | 9500 | 14900 | 0.0 | 8.2 | 10.5 | 24.3 | 0.0 | 5.84 | 1.24 | 26.1 |
| 58 | 8.65 | 10.38 | 9.04 | 1.73 | 0.39 | 74.8 | 89.6 | 9500 | 15200 | 0.0 | 8.2 | 10.2 | 24.3 | 0.0 | 6.05 | 1.25 | 20.4 |
| 59 | 8.82 | 11.90 | 9.04 | 3.08 | 0.22 | 79.5 | 89.6 | 9300 | 15200 | 0.0 | 8.0 | 10.2 | 24.4 | 0.0 | 6.02 | 1.33 | 28.7 |
| 60 | 9.41 | 10.20 | 9.04 | 0.79 | 0.37 | 70.4 | 89.6 | 9400 | 15200 | 0.0 | 8.3 | 10.2 | 24.1 | 0.0 | 7.21 | 1.33 | 25.1 |
| 61 | 8.82 | 10.20 | 9.54 | 1.38 | 0.72 | 70.4 | 92.3 | 9400 | 15000 | 0.0 | 8.3 | 10.7 | 24.1 | 0.0 | 6.10 | 1.23 | 20.3 |
| 62 | 9.15 | 10.76 | 9.04 | 1.61 | 0.11 | 86.2 | 89.6 | 9200 | 15200 | 0.0 | 8.2 | 10.2 | 23.8 | 0.0 | 6.22 | 1.24 | 20.1 |
| 63 | 9.15 | 10.39 | 9.04 | 1.24 | 0.11 | 63.1 | 89.6 | 9100 | 15200 | 0.0 | 8.1 | 10.2 | 24.2 | 0.0 | 6.24 | 1.26 | 20.3 |
| 64 | 9.15 | 10.38 | 9.10 | 1.23 | 0.05 | 74.8 | 109.8 | 9500 | 15400 | 0.0 | 8.2 | 10.5 | 24.3 | 0.0 | 6.18 | 1.22 | 21.0 |
| 65 | 9.15 | 10.38 | 9.09 | 1.23 | 0.06 | 74.8 | 73.5 | 9500 | 15300 | 0.0 | 8.2 | 10.5 | 24.3 | 0.0 | 6.20 | 1.24 | 22.7 |
| 66 | 9.15 | 10.57 | 9.08 | 1.42 | 0.07 | 84.2 | 76.2 | 9500 | 15100 | 0.0 | 8.1 | 10.2 | 24.5 | 0.0 | 6.23 | 1.23 | 20.4 |
| 67 | 9.15 | 10.39 | 9.04 | 1.24 | 0.11 | 77.2 | 89.6 | 15800 | 15200 | 0.0 | 6.1 | 10.2 | 15.7 | 0.0 | 6.71 | 1.27 | 19.7 |
| 68 | 9.15 | 10.39 | 9.04 | 1.24 | 0.11 | 73.2 | 89.6 | 4200 | 15200 | 0.0 | 21.4 | 10.2 | 33.1 | 0.0 | 6.19 | 1.24 | 20.8 |
| 69 | 9.15 | 10.38 | 9.04 | 1.23 | 0.11 | 74.8 | 101.3 | 9500 | 32200 | 0.0 | 8.2 | 10.2 | 24.3 | 0.0 | 7.31 | 1.29 | 20.1 |
| 70 | 9.15 | 10.38 | 9.04 | 1.23 | 0.11 | 74.8 | 84.2 | 9500 | 9200 | 0.0 | 8.2 | 10.4 | 24.3 | 0.0 | 6.24 | 1.23 | 20.9 |
| 71 | 9.15 | 10.38 | 9.04 | 1.23 | 0.11 | 74.8 | 89.6 | 9500 | 15200 | 0.0 | 8.2 | 10.2 | 24.3 | 0.0 | 7.20 | 1.34 | 21.6 |
| 72 | 9.15 | 10.38 | 9.04 | 1.23 | 0.11 | 74.8 | 89.6 | 9500 | 15200 | 0.0 | 8.2 | 10.2 | 24.3 | 0.0 | 6.12 | 1.28 | 24.5 |
| 73 | 9.15 | 10.38 | 9.04 | 1.23 | 0.11 | 74.8 | 89.6 | 9500 | 15200 | 0.0 | 8.2 | 10.2 | 24.3 | 0.0 | 6.75 | 1.36 | 25.4 |
| 74 | 9.15 | 10.38 | 9.04 | 1.23 | 0.11 | 74.8 | 89.6 | 9500 | 15200 | 0.0 | 8.2 | 10.2 | 24.3 | 0.0 | 6.18 | 1.24 | 20.6 |
| 75 | 9.15 | 10.38 | 9.04 | 1.23 | 0.11 | 74.8 | 89.6 | 9500 | 15200 | 0.0 | 8.2 | 10.2 | 24.3 | 0.0 | 5.99 | 1.24 | 25.1 |
| 76 | 9.15 | 10.38 | 9.04 | 1.23 | 0.11 | 74.8 | 89.6 | 9500 | 15200 | 0.0 | 8.2 | 10.2 | 24.3 | 0.0 | 7.80 | 1.54 | 35.9 |

(*) Units of δB, δH, δL, δH − δB, and |δL − δB| are each $(cal/cm^3)^{1/2}$
Units of AvB, AvH, AvL, OHvH, and OHvL are each (mgKOH/g)

Examples 1 to 54 and Comparative Examples 1 to 22

Toner 1 to Toner 76 were evaluated as follows. The evaluated results are listed in Tables 9 to 12. A modified version of a commercially-available laser printer LBP-5400 (Canon Kabushiki Kaisha) was employed as an image forming application for the evaluation. The apparatus for the evaluation was modified in the following points.

(1) The process speed was set to 190 mm/sec by changing gears in a body of the evaluation apparatus and software.

(2) A cyan cartridge was used as a cartridge in the evaluation. In more detail, the evaluation was conducted by removing product toner from a commercially-available cyan cartridge, clearing the interior of the cartridge with an air blow, and filling 200 g of the toner according to aspects of the present invention in the cartridge. Further, in the evaluation, respective product toners were removed from yellow, magenta, and black cartridges, and the yellow, magenta, and black cartridges, in which toner-residue detection mechanism were made inoperative, were inserted respectively in yellow, magenta, and black stations.

(3) Software for a fixing device was changed such that the heating temperature could be controlled to 150° C.±20° C.

[1] Durability Stability

The process cartridge filled with the toner and Canon color laser copier sheets (81.4 g/m$^2$) were left to stand in a normal-temperature and normal-humidity environment (23° C./50% RH) and in a high-temperature and high-humidity environment (32° C./83% RH) for 48 hours. Thereafter, density detection and correction were performed in each of the above-mentioned environments. A full-area solid-printed image (coated toner amount of 0.45 mg/cm$^2$) was first continuously output on 20 sheets. At that point in time, a charging rise was evaluated. Then, an image with a printing rate of 1% was output on 100 sheets. At that point in time, toner coat uniformity and transfer uniformity were evaluated. Further, such an image was continuously output until a total number of output sheets reaches 6000. The above-mentioned Canon color laser copier sheets (81.4 g/m$^2$) were used in outputting the image. In the high-temperature and high-humidity environment, the software was further modified such that a cooling fan could be controlled to be stopped. The image was then output in the stopped state of the cooling fan. After outputting 6000 sheets, development efficiency, circumferential streaks, toner scattering, toner coat uniformity, transfer uniformity, image fogging, and image density stability were evaluated.

[1-1] Development Efficiency

After outputting 6000 sheets, the full-area solid-printed image (coated toner amount of 0.45 mg/cm$^2$) was output on one sheet, and a power supply for the main body was forcibly turned off during the outputting. At that point in time, weight $W_1$ (mg) of the toner per unit area, which was held on a toner bearing member and was not yet developed, and weight $W_2$ (mg) of the toner per unit area, which was developed on a photosensitive drum, were measured and the development efficiency was determined based on the following formula:

$$\text{Development efficiency (\%)}=(W_2/W_1)\times 100$$

Evaluation criteria are as follows:

A: The development efficiency is not lower than 95%;

B: The development efficiency is not lower than 88% and lower than 95%;

C: The development efficiency is not lower than 80% and lower than 88%; and

D: The development efficiency is lower than 80%.

[1-2] Circumferential Streaks

After outputting 6000 sheets, the development container was disassembled and the surface and the end portion of the toner bearing member were visually evaluated. Evaluation criteria are as follows:

A: No foreign substances caught between the toner restriction member and the toner bearing member are observed, and no circumferential streaks are found on the toner bearing member;

B: Some foreign substances caught between the toner bearing member and the seal at the end portion of the toner bearing member are observed;

C: Occurrence of circumferential streak(s) appears in the end portion of the toner bearing member, and one to four streaks are found; and D: Circumferential streaks occur over the entire surface of the toner bearing member, and five or more streaks are found.

[1-3] Toner Coat Uniformity

Each time after outputting 100 sheets and after outputting 6000 sheets, a full-area half-tone image (coated toner amount of 0.20 mg/cm$^2$) was output respectively, and the power supply for the main body was forcibly turned off during the outputting. For each sample obtained at that time, dot reproducibility on the photosensitive drum after the development was confirmed to obtain an index for toner coat uniformity. In other words, the toner coat uniformity was evaluated by visually observing the image with an optical microscope at a magnification of ×100. Evaluation criteria are as follows:

A: The dot reproducibility is still good in the sample after outputting 6000 sheets;

B: The dot reproducibility is slightly disturbed in the sample after outputting 6000 sheets;

C: The dot reproducibility is slightly disturbed in each of the samples after outputting 100 sheets and after outputting 6000 sheets; and D: The dot reproducibility is considerably disturbed in each of the samples after outputting 100 sheets and after outputting 6000 sheets.

[1-4] Transfer Uniformity

Each time after printing 100 sheets and 6000 sheets, a full-area half-tone image (coated toner amount of 0.20 mg/cm$^2$) was transferred onto the Canon color laser copier sheet (81.4 g/m$^2$) and a sheet of Fox River Bond (90 g/m$^2$) for evaluation. Evaluation criteria are as follows:

A: Even after outputting 6000 sheets, good transfer uniformity is observed in each of the Canon color laser copier sheet and the Fox River Bond sheet;

B: Of the samples obtained after outputting 6000 sheets, slight degradation of the transfer uniformity is observed in the Fox River Bond sheet;

C: Of the samples obtained after outputting 100 sheets and after outputting 6000 sheets, slight degradation of the transfer uniformity is observed in the Fox River Bond sheet; and D: Of the samples obtained after outputting 100 sheets and after outputting 6000 sheets, degradation of the transfer uniformity is observed in the Fox River Bond sheet.

[Toner Scattering]

After outputting 6000 sheets, contamination due to the toner was observed in the cartridge and the surroundings of the cartridge inside the apparatus body. Evaluation criteria are as follows:

A: The contamination due to the toner is not observed in the cartridge and the surroundings of the cartridge inside the apparatus body;

B: The contamination due to a small amount of toner was observed in the cartridge, but image quality and attachment/detachment of the cartridge are not adversely affected;

C: The contamination due to the toner is observed in the cartridge and the surroundings of the cartridge inside the apparatus body, but image quality and attachment/detachment of the cartridge are not adversely affected; and D: The cartridge and the surroundings of the cartridge inside the apparatus body are significantly contaminated due to the toner, and image quality and attachment/detachment of the cartridge are adversely affected.

[1-6] Image Density Stability

After outputting 6000 sheets, the full-area solid-printed image (coated toner amount of 0.45 mg/cm$^2$) was output on the Canon color laser copier sheet (81.4 g/m$^2$), and the density of the image output at that time was evaluated in comparison with the density of the twentieth one of the full-area solid-printed images, which were initially continuously output on 20 sheets. The image density was measured as a relative density with respect to an image of a white area having a document density of 0.00 by using the Macbeth Reflection Densitometer RD918 (Macbeth Co.) in accordance with the appended instruction manual. Evaluation criteria are as follows:

A: A reduction rate of the density is not more than 5%;

B: A reduction rate of the density is more than 5% and not more than 10%;

C: A reduction rate of the density is more than 10% and not more than 20%; and

D: A reduction rate of the density is more than 20%.

[1-7] Image Fogging

After outputting 6000 sheets, an image with a printing rate of 1% was printed out on a Letter-size sheet of HP Color Laser Photo Paper, glossy (220 g/m$^2$) in a gloss paper mode (95 mm/sec). By using "REFLECTMETER MODEL TC-6DS" (Tokyo Denshoku Co., Ltd.), a fog density (%) was calculated from the difference between the measured degree of whiteness in a white area of the printed-out image and the degree of whiteness of transfer paper to evaluate the image fogging after printing 6000 sheets. An amber filter was used as a filter in the measurement. Evaluation criteria are as follows:

A: The fog density is less than 0.5%;

B: The fog density is not less than 0.5% and less than 1.0%;

C: The fog density is not less than 1.0% and less than 1.5%; and

D: The fog density is not less than 1.5%.

[1-8] Charging Rise

The toner charging rise was evaluated by outputting the full-area solid-printed image (coated toner amount of 0.45 mg/cm$^2$) on 20 (first to twentieth) sheets, and by determining the number of sheets printed until the image density reaches 1.40. The image density was measured by using the Macbeth Reflection Densitometer RD918 (Macbeth Co.). Evaluation criteria are as follows:

A: The number of sheets printed until the image density reaches 1.40 is 5 or less;

B: The number of sheets printed until the image density reaches 1.40 is 6 to 10;

C: The number of sheets printed until the image density reaches 1.40 is 11 to 20; and D: The image density does not reach 1.40 even at the time of outputting the twentieth sheet.

[2] Environmental Storage Stability

A process cartridge filled with the toner and a 50-ml plastic cup including the weighed toner (5 g) were left to stand for 5 days in a high-temperature environment (55° C./10% RH), 60 days in a high-temperature and high-humidity environment (40° C./95% RH), and 10 days in a cyclic high-temperature environment (in which steps of raising temperature from 25° C. to 55° C. in 11 hours, holding 55° C. for 1 hour, lowering temperature to 25° C. in 11 hours, and holding 25° C. for 1 hour were repeated, and the humidity was adjusted to 10% RH in the state of 55° C.)

[2-1] Blocking Resistance

After leaving the plastic cup to stand in each of the above-mentioned environments, the storage stability was evaluated by observing an aggregated state of the toner that had been weighed and put in the plastic cup. Evaluation criteria are as follows:

A: No aggregation of the toner is found;

B: The toner is slightly aggregated;

C: The toner is more noticeably aggregated; and

D: The toner is significantly aggregated.

[2-2] After-Storage Durability

The above-mentioned process cartridge was further left to stand in a normal-temperature and normal-humidity environment (23° C./50% RH) for 48 hours. Thereafter, density detection and correction were performed in the above-mentioned environments. Further, an image with a printing rate of 1% was printed on 6000 sheets. The Canon color laser copier sheets (81.4 g/m$^2$) were used as the print sheets. After outputting 6000 sheets, the development efficiency and the circumferential streaks were evaluated for the samples that had been left to stand in the high-temperature environment and the cyclic high-temperature environment, whereas the toner scattering and the density stability were evaluated for the sample that had been left to stand in the high-temperature and high-humidity environment. Evaluation criteria are the same as those described above regarding the evaluation of the durability stability.

[3] Fixation Ability

The following items [3-1] to [3-3] were evaluated in relation to the fixation ability of the toner:

[3-1] Low-Temperature Fixation Ability

The process cartridge filled with the toner was left to stand in the normal-temperature and normal-humidity environment (23° C./50% RH) for 48 hours. Thereafter, a still-unfixed image of an image pattern was output, the image pattern including square images of 10 mm×10 mm, which are evenly arrayed at 9 points over an entire sheet of transfer paper. The amount of the toner coated on the sheet of the transfer paper was set to 0.35 mg/cm$^2$, and the fixation start temperature was evaluated. A sheet of Fox River Bond (90 g/m$^2$) was used as the transfer paper. A fixing device was prepared as an external fixing device that was obtained by taking out the fixing device of LBP-5400 (Canon Kabushiki Kaisha) and modifying it such that the fixing device could operate even outside the laser beam printer. Further, the external fixing device was used in the measurement by making the fixing temperature optionally settable and by setting the process speed to 190 mm/sec as the fixing condition.

The start of the fixation was determined as follows. The fixed image (including the low-temperature offset image) was rubbed with a sheet of Silbon (lens-cleaning) paper [Lenz Cleaning Paper "dasper(R)" (Ozu Paper Co. Ltd)] under a load of 50 g/cm$^2$, and the temperature at which a density reduction rate between before and after the rubbing was reduced blow 20% was defined as the fixation start point. Evaluation criteria are as follows:

A: The fixation start point is not higher than 130° C.;

B: The fixation start point is higher than 130° C. and not higher than 140° C.;

C: The fixation start point is higher than 140° C. and not higher than 150° C.; and D: The fixation start point is higher than 150° C.

[3-2] Wrapping Resistance at High Temperatures

For evaluating the wrapping resistance at high temperatures, the fixation evaluation was first performed under the same conditions as those described above in [3-1]. Then, a maximum temperature at which the sheet was able to pass through without wrapping was determined as temperature for the evaluation of the wrapping resistance at high temperatures. Evaluation criteria are as follows:

A: The maximum temperature at which the sheet is able to pass through without wrapping is not lower than 190° C.;

B: The maximum temperature at which the sheet is able to pass through without wrapping is not lower than 180° C. and lower than 190° C.;

C: The maximum temperature at which the sheet is able to pass through without wrapping is not lower than 170° C. and lower than 180° C.; and D: The maximum temperature at which the sheet is able to pass through without wrapping is lower than 170° C.

[3-3] Glossiness

A fixed image was obtained by modifying conditions such that the transfer sheet was changed to a Letter-size sheet of HP Color Laser Photo Paper, glossy (220 g/m$^2$), the fixing temperature was held at 180° C., and the process speed was changed to 95 mm/sec. The glossiness of the obtained fixed image was measured by using a gloss meter PG-3D (NIPPON DENSHOKU INDUSTRIES CO., LTD.) in accordance with the appended instruction manual. Evaluation criteria are as follows:

A: The glossiness is not lower than 70;

B: The glossiness is not lower than 60 and lower than 70;

C: The glossiness is not lower than 50 and lower than 60; and

D: The glossiness is lower than 50.

TABLE 9

| EXAMPLE/ COMPARATIVE | | Durability Stability | | | | | | | | | | | | | | | |
|---|---|---|---|---|---|---|---|---|---|---|---|---|---|---|---|---|---|
| | | Development Efficiency | | Circumferential Streak | | Toner Coat Uniformity | | Transfer Uniformity | | Toner Scattering | | Image Density Stability | | Image Fogging | | Charging Rise | |
| EXAMPLE | Toner | N/N | H/H | N/N | H/H | N/N | H/H | N/N | H/H | N/N | H/H | N/N | H/H | N/N | H/H | N/N | H/H |
| EXAMPLE 1 | 1 | A(98) | A(98) | A | A | A | A | A | A | A | A | A(2) | A(2) | A(0.2) | A(0.3) | A(1) | A(2) |
| EXAMPLE 2 | 2 | A(98) | A(98) | A | A | A | A | A | A | A | A | A(2) | A(3) | A(0.2) | A(0.4) | A(1) | A(4) |
| EXAMPLE 3 | 3 | A(98) | A(98) | A | A | A | A | A | A | A | A | A(2) | A(3) | A(0.2) | A(0.3) | A(1) | A(2) |
| EXAMPLE 4 | 4 | A(98) | A(98) | A | A | A | A | A | A | A | A | A(2) | A(3) | A(0.2) | B(0.6) | A(2) | B(6) |
| EXAMPLE 5 | 5 | A(98) | A(98) | A | A | A | A | A | A | A | A | A(3) | A(4) | A(0.2) | A(0.5) | A(2) | A(5) |
| EXAMPLE 6 | 6 | A(97) | A(96) | A | B | A | A | A | A | A | A | A(2) | A(2) | A(0.2) | A(0.3) | A(1) | A(2) |
| EXAMPLE 7 | 7 | A(97) | A(96) | A | A | A | A | A | A | A | A | A(2) | A(2) | A(0.2) | A(0.3) | A(1) | A(2) |
| EXAMPLE 8 | 8 | A(96) | A(96) | A | B | A | A | A | A | A | A | A(2) | A(3) | A(0.2) | A(0.3) | A(1) | A(2) |
| EXAMPLE 9 | 9 | A(96) | B(94) | A | A | A | A | A | A | A | A | A(2) | A(3) | A(0.2) | A(0.3) | A(1) | A(2) |
| EXAMPLE 10 | 10 | A(96) | B(93) | A | B | A | B | A | A | A | A | A(2) | A(3) | A(0.2) | A(0.3) | A(1) | A(3) |
| EXAMPLE 11 | 11 | A(98) | A(98) | A | A | A | A | A | A | A | A | A(2) | A(3) | A(0.3) | A(0.4) | A(1) | A(2) |
| EXAMPLE 12 | 12 | A(98) | A(98) | A | B | A | A | A | B | A | B | A(2) | A(3) | A(0.4) | B(0.6) | A(1) | B(2) |
| EXAMPLE 13 | 13 | A(98) | A(98) | A | A | A | A | A | A | A | A | A(3) | A(3) | A(0.2) | A(0.3) | A(1) | A(2) |
| EXAMPLE 14 | 14 | A(98) | B(94) | A | B | A | B | A | B | A | A | A(2) | A(2) | A(0.2) | A(0.3) | A(1) | A(2) |
| EXAMPLE 15 | 15 | A(98) | A(98) | A | A | A | A | A | A | A | A | A(2) | A(2) | A(0.4) | B(0.6) | A(1) | A(2) |
| EXAMPLE 16 | 16 | A(98) | A(98) | A | A | A | A | A | A | A | A | A(2) | A(2) | A(0.2) | A(0.3) | A(1) | A(2) |
| EXAMPLE 17 | 17 | A(98) | A(98) | A | A | A | A | A | A | A | A | A(3) | A(3) | A(0.4) | B(0.5) | A(1) | A(2) |
| EXAMPLE 18 | 18 | A(96) | B(94) | A | B | A | B | A | B | A | A | A(2) | A(2) | A(0.2) | A(0.3) | A(1) | A(2) |
| EXAMPLE 19 | 19 | A(98) | B(93) | A | A | A | A | A | B | A | B | A(2) | B(6) | A(0.2) | C(1.1) | A(1) | C(12) |
| EXAMPLE 20 | 20 | A(98) | B(94) | A | A | A | A | A | A | A | A | A(3) | A(4) | A(0.2) | B(0.6) | A(1) | A(5) |
| EXAMPLE 21 | 21 | A(98) | B(94) | A | B | A | B | A | A | A | A | A(2) | A(3) | A(0.2) | A(0.5) | A(3) | A(5) |
| EXAMPLE 22 | 22 | A(98) | A(95) | A | A | A | A | A | A | A | A | A(2) | A(3) | A(0.2) | A(0.3) | A(1) | A(2) |
| EXAMPLE 23 | 23 | A(97) | B(90) | A | B | A | B | A | B | A | B | A(2) | B(6) | B(0.6) | C(1.2) | B(6) | C(13) |
| EXAMPLE 24 | 24 | A(98) | B(90) | A | B | A | B | A | A | A | A | A(2) | A(5) | A(0.2) | A(0.5) | A(2) | A(5) |
| EXAMPLE 25 | 25 | A(98) | B(94) | A | B | A | A | A | A | A | A | A(2) | A(4) | A(0.2) | A(0.4) | A(1) | A(4) |
| EXAMPLE 26 | 26 | A(98) | A(96) | A | A | A | A | A | B | A | A | A(2) | B(7) | A(0.2) | A(0.4) | A(2) | A(3) |
| EXAMPLE 27 | 27 | A(98) | A(97) | A | A | A | A | A | A | A | B | A(2) | A(3) | A(0.3) | B(0.6) | A(4) | B(8) |
| EXAMPLE 28 | 28 | A(98) | A(95) | A | A | A | A | B | B | A | A | B(6) | C(13) | A(0.3) | A(0.5) | A(2) | A(5) |
| EXAMPLE 29 | 29 | A(98) | B(94) | A | B | A | B | A | A | A | B | A(2) | A(3) | A(0.3) | B(0.7) | B(6) | C(11) |
| EXAMPLE 30 | 30 | A(97) | B(94) | A | B | A | A | A | A | A | B | A(2) | A(2) | A(0.3) | B(0.7) | A(2) | A(3) |
| EXAMPLE 31 | 31 | A(98) | B(94) | A | B | A | A | A | A | A | A | A(2) | A(3) | A(0.2) | A(0.3) | A(2) | A(3) |
| EXAMPLE 32 | 32 | B(94) | B(90) | B | C | A | A | A | A | B | B | A(2) | A(3) | B(0.6) | C(1.4) | A(2) | A(4) |
| EXAMPLE 33 | 33 | A(98) | A(95) | A | B | A | A | A | A | A | B | A(2) | A(5) | A(0.2) | A(0.4) | A(2) | B(6) |
| EXAMPLE 34 | 34 | A(98) | B(94) | A | B | A | B | A | A | A | A | A(2) | A(5) | A(0.2) | A(0.5) | A(2) | A(5) |
| EXAMPLE 35 | 35 | A(98) | A(96) | A | A | A | A | A | B | A | A | A(2) | B(6) | A(0.2) | A(0.3) | A(2) | A(3) |
| EXAMPLE 36 | 36 | A(98) | A(96) | A | A | A | A | A | A | A | B | A(2) | A(3) | A(0.3) | B(0.6) | A(3) | B(6) |
| EXAMPLE 37 | 37 | A(98) | A(95) | A | A | A | A | B | C | A | A | B(6) | C(13) | A(0.2) | A(0.5) | A(3) | A(5) |
| EXAMPLE 38 | 38 | A(98) | A(95) | A | A | A | A | A | A | B | B | A(2) | A(3) | B(0.6) | C(1.3) | A(4) | B(6) |
| EXAMPLE 39 | 39 | A(98) | A(97) | A | A | A | A | A | A | A | A | A(2) | B(3) | A(0.3) | A(0.6) | A(2) | A(3) |
| EXAMPLE 40 | 40 | A(98) | A(97) | A | A | A | A | A | A | A | A | A(2) | A(3) | A(0.3) | A(0.5) | A(3) | A(5) |

* In Table, N/N represents a normal-temperature and normal-humidity environment (23° C./50% RH), and H/H represents a high-temperature and high-humidity environment (32° C./83% RH).

TABLE 10

| EXAMPLE/ COMPARATIVE EXAMPLE | Toner | Durability Stability: Development Efficiency N/N | Development Efficiency H/H | Circumferential Streak N/N | Circumferential Streak H/H | Toner Coat Uniformity N/N | Toner Coat Uniformity H/H | Transfer Uniformity N/N | Transfer Uniformity H/H | Toner Scattering N/N | Toner Scattering H/H | Image Density Stability N/N | Image Density Stability H/H | Image Fogging N/N | Image Fogging H/H | Charging Rise N/N | Charging Rise H/H |
|---|---|---|---|---|---|---|---|---|---|---|---|---|---|---|---|---|---|
| EXAMPLE 41 | 41 | A(98) | A(96) | A | A | A | A | B | B | A | A | B(3) | B(4) | A(0.6) | A(0.9) | A(2) | A(4) |
| EXAMPLE 42 | 42 | A(98) | A(96) | A | A | A | A | A | A | A | B | A(3) | A(4) | A(0.4) | B(0.7) | A(3) | B(8) |
| EXAMPLE 43 | 43 | A(98) | A(95) | A | A | A | A | A | A | B | C | A(3) | A(5) | B(0.6) | C(1.4) | B(3) | C(12) |
| EXAMPLE 44 | 44 | A(98) | A(96) | A | A | A | A | A | A | A | A | A(2) | A(3) | A(0.2) | A(0.4) | A(2) | A(3) |
| EXAMPLE 45 | 45 | B(94) | C(87) | B | C | B | C | A | A | A | A | A(3) | B(7) | A(0.2) | A(0.5) | A(2) | B(7) |
| EXAMPLE 46 | 46 | A(98) | A(96) | A | A | A | A | A | A | A | A | A(2) | B(6) | A(0.2) | A(0.5) | A(2) | A(5) |
| EXAMPLE 47 | 47 | A(98) | A(96) | A | A | A | A | A | A | A | A | A(2) | B(6) | A(0.2) | A(0.5) | A(2) | A(5) |
| EXAMPLE 48 | 48 | A(97) | A(95) | A | A | A | A | A | B | A | A | B(6) | C(12) | A(0.3) | B(0.8) | A(3) | B(7) |
| EXAMPLE 49 | 49 | A(97) | A(95) | A | A | A | A | A | B | A | A | B(6) | C(13) | A(0.3) | B(0.7) | A(3) | B(8) |
| EXAMPLE 50 | 50 | B(94) | B(92) | B | B | B | B | B | C | B | C | B(6) | C(12) | B(0.6) | C(1.3) | B(6) | C(11) |
| EXAMPLE 51 | 51 | A(98) | A(98) | A | A | A | A | A | A | A | A | A(2) | A(2) | A(0.2) | A(0.3) | A(1) | A(2) |
| EXAMPLE 52 | 52 | A(98) | A(96) | B | B | A | A | A | B | A | A | A(4) | B(9) | A(0.5) | B(1) | A(5) | B(9) |
| EXAMPLE 53 | 53 | A(95) | B(89) | B | B | A | B | A | B | A | B | A(5) | B(10) | A(0.2) | A(0.5) | A(5) | B(9) |
| EXAMPLE 54 | 54 | A(96) | A(95) | B | B | A | A | A | B | B | C | B(6) | C(15) | B(0.7) | C(1.3) | B(6) | C(17) |
| COMPARATIVE EXAMPLE 1 | 55 | A(96) | A(95) | B | B | A | A | A | B | B | C | B(8) | C(16) | B(0.8) | C(1.5) | B(6) | C(18) |
| COMPARATIVE EXAMPLE 2 | 56 | B(93) | D(78) | B | D | C | D | B | C | C | C | C(11) | C(14) | C(1.1) | C(1.3) | B(8) | C(12) |
| COMPARATIVE EXAMPLE 3 | 57 | A(96) | A(95) | B | B | A | A | B | C | C | D | C(12) | D(21) | C(1.2) | D(1.6) | C(11) | D |
| COMPARATIVE EXAMPLE 4 | 58 | A(96) | A(96) | B | B | A | A | A | B | C | D | C(12) | D(21) | B(0.7) | C(1.3) | B(7) | C(16) |
| COMPARATIVE EXAMPLE 5 | 59 | A(96) | A(96) | B | B | A | A | A | B | B | C | B(9) | C(18) | C(1.2) | D(1.8) | C(11) | D |
| COMPARATIVE EXAMPLE 6 | 60 | A(96) | A(95) | B | B | A | A | B | C | C | D | C(14) | D(22) | C(1.2) | D(1.7) | C(12) | D |
| COMPARATIVE EXAMPLE 7 | 61 | B(93) | C(87) | C | D | B | C | B | C | B | C | B(6) | C(12) | B(0.6) | C(1.2) | B(6) | C(18) |
| COMPARATIVE EXAMPLE 8 | 62 | B(93) | B(91) | C | C | B | B | B | C | B | C | B(7) | C(13) | B(0.7) | C(1.3) | B(8) | C(17) |
| COMPARATIVE EXAMPLE 9 | 63 | B(93) | B(91) | C | D | B | B | B | C | B | C | B(8) | C(13) | B(0.6) | C(1.3) | B(7) | C(18) |
| COMPARATIVE EXAMPLE 10 | 64 | C(87) | C(86) | D | D | C | C | C | D | B | C | B(7) | C(15) | B(0.8) | C(1.4) | B(6) | C(17) |
| COMPARATIVE EXAMPLE 11 | 65 | A(95) | B(89) | B | C | A | B | A | B | B | C | B(7) | C(16) | B(0.8) | C(1.5) | B(7) | C(18) |
| COMPARATIVE EXAMPLE 12 | 66 | C(87) | C(85) | D | D | C | C | C | D | B | C | B(7) | C(15) | B(0.9) | C(1.4) | B(7) | C(18) |
| COMPARATIVE EXAMPLE 13 | 67 | A(96) | A(95) | B | B | A | A | A | B | B | C | B(8) | C(16) | C(1.1) | C(1.5) | B(7) | C(18) |
| COMPARATIVE EXAMPLE 14 | 68 | A(95) | A(95) | B | C | A | A | B | C | C | D | B(8) | C(16) | C(1.1) | C(1.5) | B(7) | C(18) |
| COMPARATIVE EXAMPLE 15 | 69 | A(96) | A(95) | A | A | A | A | A | B | B | C | B(8) | C(16) | B(0.8) | C(1.5) | B(7) | C(18) |
| COMPARATIVE EXAMPLE 16 | 70 | A(95) | B(94) | B | C | A | B | B | C | B | C | B(8) | C(16) | B(0.7) | C(1.5) | B(7) | C(18) |
| COMPARATIVE EXAMPLE 17 | 71 | A(96) | A(95) | B | B | A | A | A | B | B | C | B(8) | C(16) | C(1.1) | C(1.5) | B(7) | C(18) |
| COMPARATIVE EXAMPLE 18 | 72 | A(96) | A(95) | B | B | A | A | A | B | B | C | B(7) | C(15) | B(0.8) | C(1.3) | B(7) | C(18) |
| COMPARATIVE EXAMPLE 19 | 73 | A(96) | A(95) | B | B | A | A | A | B | B | C | B(8) | C(16) | C(1.1) | C(1.5) | B(7) | C(18) |
| COMPARATIVE EXAMPLE 20 | 74 | B(93) | B(92) | B | C | B | B | B | C | B | C | B(7) | C(15) | B(0.8) | C(1.3) | B(7) | C(18) |
| COMPARATIVE EXAMPLE 21 | 75 | B(89) | B(88) | C | C | B | B | B | C | C | D | C(12) | D(22) | C(1.2) | C(1.5) | C(18) | D |
| COMPARATIVE EXAMPLE 22 | 76 | D(78) | D(75) | D | D | D | D | C | D | C | D | C(19) | D(25) | C(1.2) | C(1.5) | C(18) | D |

* In Table, N/N represents a normal-temperature and normal-humidity environment (23° C./50% RH), and H/H represents a high-temperature and high-humidity environment (32° C./83% RH).

TABLE 11

| EXAMPLE/ COMPARATIVE EXAMPLE | Toner | Environmental Storage Stability | | | | | | |
|---|---|---|---|---|---|---|---|---|
| | | Blocking Resistance | | | After-Storage Durability | | | |
| | | | | | Development Efficiency | | Circumferential Streak | |
| | | High Temperature | Cyclic High Temperature | High Temperature/ High Humidity | High Temperature | Cyclic High Temperature | High Temperature | Cyclic High Temperature |
| EXAMPLE 1 | 1 | A | A | A | A(97) | A(97) | A | A |
| EXAMPLE 2 | 2 | A | B | A | A(97) | A(97) | A | A |
| EXAMPLE 3 | 3 | A | A | A | A(96) | A(96) | A | A |
| EXAMPLE 4 | 4 | A | A | B | A(97) | A(97) | A | A |
| EXAMPLE 5 | 5 | A | B | A | A(95) | A(95) | A | A |
| EXAMPLE 6 | 6 | A | A | A | A(96) | A(95) | A | A |
| EXAMPLE 7 | 7 | A | A | A | A(97) | A(96) | A | A |
| EXAMPLE 8 | 8 | B | B | A | A(95) | B(92) | A | B |
| EXAMPLE 9 | 9 | A | A | A | A(95) | A(95) | A | A |
| EXAMPLE 10 | 10 | B | B | A | A(95) | B(90) | A | B |
| EXAMPLE 11 | 11 | A | A | A | A(97) | A(96) | A | A |
| EXAMPLE 12 | 12 | B | B | A | A(96) | B(90) | A | B |
| EXAMPLE 13 | 13 | A | A | A | A(96) | A(96) | A | A |
| EXAMPLE 14 | 14 | B | B | A | A(95) | B(90) | A | B |
| EXAMPLE 15 | 15 | A | A | A | A(96) | A(96) | A | A |
| EXAMPLE 16 | 16 | B | C | A | B(93) | B(92) | B | B |
| EXAMPLE 17 | 17 | A | A | A | A(96) | A(95) | A | A |
| EXAMPLE 18 | 18 | A | B | A | A(96) | A(95) | A | A |
| EXAMPLE 19 | 19 | A | A | C | A(97) | A(97) | A | A |
| EXAMPLE 20 | 20 | B | B | A | B(93) | B(92) | B | B |
| EXAMPLE 21 | 21 | A | A | A | A(96) | B(93) | A | B |
| EXAMPLE 22 | 22 | A | A | A | A(97) | A(97) | A | A |
| EXAMPLE 23 | 23 | A | B | C | A(95) | B(90) | A | B |
| EXAMPLE 24 | 24 | A | A | A | A(96) | A(95) | A | A |
| EXAMPLE 25 | 25 | B | B | A | A(95) | B(90) | A | B |
| EXAMPLE 26 | 26 | B | B | B | A(97) | B(94) | A | B |
| EXAMPLE 27 | 27 | B | B | A | A(97) | B(94) | A | B |
| EXAMPLE 28 | 28 | B | B | C | A(96) | B(92) | A | B |
| EXAMPLE 29 | 29 | B | B | A | A(97) | B(90) | A | B |
| EXAMPLE 30 | 30 | A | B | A | A(97) | A(95) | A | A |
| EXAMPLE 31 | 31 | B | B | A | A(97) | A(96) | A | A |
| EXAMPLE 32 | 32 | A | B | A | A(97) | B(92) | A | B |
| EXAMPLE 33 | 33 | B | C | A | B(94) | B(92) | B | B |
| EXAMPLE 34 | 34 | A | B | A | A(95) | A(95) | A | A |
| EXAMPLE 35 | 35 | A | A | B | A(97) | A(96) | A | A |
| EXAMPLE 36 | 36 | A | A | A | A(97) | A(96) | A | A |
| EXAMPLE 37 | 37 | A | A | C | A(96) | A(95) | A | A |
| EXAMPLE 38 | 38 | A | A | A | A(95) | A(95) | A | A |
| EXAMPLE 39 | 39 | A | A | A | A(96) | A(96) | A | A |
| EXAMPLE 40 | 40 | A | A | A | A(97) | A(96) | A | A |

| EXAMPLE/ COMPARATIVE EXAMPLE | Environmental Storage Stability After-Storage Durability | | Fixation Ability | | |
|---|---|---|---|---|---|
| | Toner Scattering | Density Stability | | | |
| | High Temperature/ High Humidity | High Temperature/ High Humidity | Low-Temperature Fixation Ability | Wrapping Resistance at High Temperature | Glossiness |
| EXAMPLE 1 | A | A(3) | A(120) | A(210) | A(82) |
| EXAMPLE 2 | A | A(5) | A(120) | A(210) | A(81) |
| EXAMPLE 3 | A | A(3) | A(120) | A(210) | A(82) |
| EXAMPLE 4 | A | A(5) | A(120) | A(210) | A(82) |
| EXAMPLE 5 | A | A(4) | A(120) | A(210) | A(83) |
| EXAMPLE 6 | A | A(3) | A(120) | A(210) | A(85) |
| EXAMPLE 7 | A | A(3) | B(135) | A(215) | A(72) |
| EXAMPLE 8 | A | A(4) | A(120) | A(200) | A(87) |
| EXAMPLE 9 | A | A(3) | B(135) | A(215) | B(69) |
| EXAMPLE 10 | A | A(3) | A(120) | A(205) | A(84) |
| EXAMPLE 11 | A | A(3) | B(135) | A(215) | B(64) |
| EXAMPLE 12 | A | A(3) | A(120) | B(185) | A(86) |
| EXAMPLE 13 | A | A(3) | B(135) | A(215) | B(62) |
| EXAMPLE 14 | A | A(3) | A(120) | B(195) | A(85) |
| EXAMPLE 15 | A | B(6) | B(135) | A(220) | C(58) |
| EXAMPLE 16 | A | A(3) | A(120) | B(185) | A(85) |

TABLE 11-continued

| | | | | | |
|---|---|---|---|---|---|
| EXAMPLE 17 | A | A(3) | B(135) | A(220) | C(59) |
| EXAMPLE 18 | A | A(3) | A(120) | A(190) | A(86) |
| EXAMPLE 19 | B | B(9) | A(120) | A(210) | A(77) |
| EXAMPLE 20 | A | A(4) | A(120) | A(210) | A(83) |
| EXAMPLE 21 | A | A(5) | A(120) | A(210) | A(80) |
| EXAMPLE 22 | A | A(3) | A(120) | A(210) | A(84) |
| EXAMPLE 23 | B | B(7) | A(120) | A(210) | A(78) |
| EXAMPLE 24 | A | A(5) | A(120) | A(210) | A(81) |
| EXAMPLE 25 | A | A(5) | A(120) | A(210) | A(83) |
| EXAMPLE 26 | A | A(5) | A(125) | A(210) | A(78) |
| EXAMPLE 27 | A | A(5) | A(120) | A(210) | A(83) |
| EXAMPLE 28 | B | B(8) | A(125) | A(210) | A(75) |
| EXAMPLE 29 | A | A(5) | A(120) | A(210) | A(84) |
| EXAMPLE 30 | A | A(3) | A(125) | A(210) | A(79) |
| EXAMPLE 31 | A | A(3) | A(120) | A(205) | A(84) |
| EXAMPLE 32 | A | A(5) | A(130) | A(215) | A(77) |
| EXAMPLE 33 | A | A(5) | A(120) | A(200) | A(84) |
| EXAMPLE 34 | A | A(5) | A(120) | A(210) | A(80) |
| EXAMPLE 35 | A | B(8) | A(120) | A(210) | A(79) |
| EXAMPLE 36 | A | A(4) | A(120) | A(210) | A(81) |
| EXAMPLE 37 | B | C(14) | A(125) | A(215) | A(77) |
| EXAMPLE 38 | B | A(5) | A(120) | A(205) | A(83) |
| EXAMPLE 39 | A | A(3) | A(120) | A(210) | A(79) |
| EXAMPLE 40 | A | A(3) | A(120) | A(210) | A(80) |

* In Table, "High Temperature" represents a high-temperature environment (55° C./10% RH), "High Temperature/High Humidity" represents a high-temperature and high-humidity environment (40° C./95% RH), and "Cyclic High Temperature" represents a cyclic high-temperature environment (25° C.⇔55° C./10% RH) described in the specification.

TABLE 12

| EXAMPLE/ COMPARATIVE EXAMPLE | Toner | Environmental Storage Stability | | | | | | |
|---|---|---|---|---|---|---|---|---|
| | | Blocking Resistance | | | After-Storage Durability | | | |
| | | | | High Temperature/ | Development Efficiency | | Circumferential Streak | |
| | | High Temperature | Cyclic High Temperature | High Humidity | High Temperature | Cyclic High Temperature | High Temperature | Cyclic High Temperature |
| EXAMPLE 41 | 41 | A | A | B | A(96) | A(95) | A | A |
| EXAMPLE 42 | 42 | A | B | A | A(96) | A(95) | A | A |
| EXAMPLE 43 | 43 | B | B | A | B(93) | B(92) | B | B |
| EXAMPLE 44 | 44 | B | C | A | B(93) | B(92) | B | B |
| EXAMPLE 45 | 45 | A | B | C | B(89) | B(88) | B | B |
| EXAMPLE 46 | 46 | A | A | A | A(96) | A(96) | A | A |
| EXAMPLE 47 | 47 | A | A | A | A(96) | A(96) | A | A |
| EXAMPLE 48 | 48 | A | A | A | A(95) | A(95) | A | A |
| EXAMPLE 49 | 49 | A | A | A | A(95) | A(95) | A | A |
| EXAMPLE 50 | 50 | A | A | A | B(91) | B(89) | B | B |
| EXAMPLE 51 | 51 | A | A | A | A(97) | A(97) | A | A |
| EXAMPLE 52 | 52 | A | B | A | A(95) | B(93) | A | B |
| EXAMPLE 53 | 53 | B | C | B | B(92) | C(87) | B | C |
| EXAMPLE 54 | 54 | B | C | B | B(94) | B(92) | B | B |
| COMPARATIVE EXAMPLE 1 | 55 | C | D | B | C(85) | D(78) | C | D |
| COMPARATIVE EXAMPLE 2 | 56 | B | D | C | B(90) | D(76) | B | D |
| COMPARATIVE EXAMPLE 3 | 57 | D | D | C | D(78) | D(76) | D | D |
| COMPARATIVE EXAMPLE 4 | 58 | B | C | B | B(89) | B(90) | B | B |
| COMPARATIVE EXAMPLE 5 | 59 | B | C | D | B(93) | B(92) | B | B |
| COMPARATIVE EXAMPLE 6 | 60 | D | D | C | D(78) | D(77) | D | D |
| COMPARATIVE EXAMPLE 7 | 61 | B | C | B | C(86) | D(77) | C | D |
| COMPARATIVE EXAMPLE 8 | 62 | B | C | B | B(93) | B(91) | B | B |
| COMPARATIVE EXAMPLE 9 | 63 | C | D | B | C(82) | D(70) | C | D |
| COMPARATIVE EXAMPLE 10 | 64 | B | C | B | B(89) | B(89) | B | B |
| COMPARATIVE EXAMPLE 11 | 65 | C | D | B | C(82) | D(70) | C | D |

TABLE 12-continued

| | | | | | | | | |
|---|---|---|---|---|---|---|---|---|
| COMPARATIVE EXAMPLE 12 | 66 | B | C | B | B(88) | B(88) | B | B |
| COMPARATIVE EXAMPLE 13 | 67 | B | B | B | B(93) | B(90) | B | B |
| COMPARATIVE EXAMPLE 14 | 68 | C | D | B | C(81) | D(70) | C | D |
| COMPARATIVE EXAMPLE 15 | 69 | B | B | B | B(93) | B(90) | B | B |
| COMPARATIVE EXAMPLE 16 | 70 | C | D | B | C(81) | D(70) | C | D |
| COMPARATIVE EXAMPLE 17 | 71 | B | B | B | B(93) | B(90) | B | B |
| COMPARATIVE EXAMPLE 18 | 72 | D | D | B | D(75) | D(72) | D | D |
| COMPARATIVE EXAMPLE 19 | 73 | B | B | B | B(93) | B(90) | B | B |
| COMPARATIVE EXAMPLE 20 | 74 | B | D | B | B(88) | D(72) | B | D |
| COMPARATIVE EXAMPLE 21 | 75 | C | D | B | C(83) | C(81) | C | C |
| COMPARATIVE EXAMPLE 22 | 76 | D | D | C | D(72) | D(70) | D | D |

| | Environmental Storage Stability After-Storage Durability | | | | |
|---|---|---|---|---|---|
| | Toner Scattering | Density | Fixation Ability | | |
| EXAMPLE/ COMPARATIVE EXAMPLE | High Temperature/ High Humidity | Stability High Temperature/ High Humidity | Low-Temperature Fixation Ability | Wrapping Resistance at High Temperature | Glossiness |
| EXAMPLE 41 | A | A(4) | A(125) | A(215) | A(78) |
| EXAMPLE 42 | A | A(5) | A(120) | A(205) | A(80) |
| EXAMPLE 43 | A | A(5) | A(120) | A(200) | A(81) |
| EXAMPLE 44 | A | A(4) | A(130) | B(185) | B(67) |
| EXAMPLE 45 | B | B(7) | B(140) | A(200) | B(68) |
| EXAMPLE 46 | A | A(5) | A(120) | A(210) | A(81) |
| EXAMPLE 47 | A | A(5) | A(120) | A(210) | A(82) |
| EXAMPLE 48 | B | B(9) | A(120) | A(210) | A(82) |
| EXAMPLE 49 | B | B(8) | A(120) | A(210) | A(81) |
| EXAMPLE 50 | B | B(9) | A(120) | A(210) | A(80) |
| EXAMPLE 51 | A | A(3) | A(120) | A(210) | A(84) |
| EXAMPLE 52 | B | B(8) | A(130) | B(185) | A(74) |
| EXAMPLE 53 | B | B(9) | B(140) | B(180) | B(67) |
| EXAMPLE 54 | B | B(8) | A(130) | B(185) | A(72) |
| COMPARATIVE EXAMPLE 1 | B | B(9) | A(130) | B(185) | B(69) |
| COMPARATIVE EXAMPLE 2 | C | C(12) | C(145) | A(200) | C(58) |
| COMPARATIVE EXAMPLE 3 | C | C(18) | A(130) | B(185) | A(74) |
| COMPARATIVE EXAMPLE 4 | B | B(9) | A(130) | B(185) | A(71) |
| COMPARATIVE EXAMPLE 5 | D | D(22) | A(130) | B(185) | A(73) |
| COMPARATIVE EXAMPLE 6 | C | C(18) | A(130) | B(180) | A(72) |
| COMPARATIVE EXAMPLE 7 | B | B(9) | A(130) | B(185) | A(74) |
| COMPARATIVE EXAMPLE 8 | B | B(9) | C(150) | B(185) | D(48) |
| COMPARATIVE EXAMPLE 9 | B | B(10) | A(130) | B(185) | A(76) |
| COMPARATIVE EXAMPLE 10 | B | B(9) | C(150) | B(185) | D(45) |
| COMPARATIVE EXAMPLE 11 | B | B(10) | A(130) | B(185) | A(73) |
| COMPARATIVE EXAMPLE 12 | B | B(9) | A(130) | B(185) | A(71) |
| COMPARATIVE EXAMPLE 13 | B | B(9) | C(150) | B(185) | D(40) |
| COMPARATIVE EXAMPLE 14 | C | B(8) | A(130) | C(185) | A(75) |
| COMPARATIVE EXAMPLE 15 | B | B(9) | C(150) | B(185) | D(38) |

TABLE 12-continued

| | | | | | |
|---|---|---|---|---|---|
| COMPARATIVE EXAMPLE 16 | B | B(8) | A(130) | B(185) | A(75) |
| COMPARATIVE EXAMPLE 17 | B | C(11) | B(140) | B(185) | D(41) |
| COMPARATIVE EXAMPLE 18 | B | B(9) | A(120) | C(180) | A(76) |
| COMPARATIVE EXAMPLE 19 | B | B(9) | D(160) | B(185) | D(39) |
| COMPARATIVE EXAMPLE 20 | B | B(9) | A(120) | C(180) | A(76) |
| COMPARATIVE EXAMPLE 21 | B | B(9) | A(130) | B(185) | A(71) |
| COMPARATIVE EXAMPLE 22 | D | D(28) | B(140) | D(160) | C(55) |

* In Table, "High Temperature" represents a high-temperature environment (55° C./10% RH), "High Temperature/High Humidity" represents a high-temperature and high-humidity environment (40° C./95% RH), and "Cyclic High Temperature" represents a cyclic high-temperature environment (25° C.⇔ 55° C./10% RH) described in the specification.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-082819 filed Mar. 31, 2010, which is hereby incorporated by reference herein in its entirety.

What is claimed is:

1. A toner comprising a toner particle that comprises:

a binding resin;

a colorant;

a polar resin H; and a polar resin L, wherein the toner particle is obtained with granulation in a water-based medium, and the polar resin H and the polar resin L are each a polar resin containing a carboxyl group and having an acid value of 3.0 (mgKOH/g) or more, wherein when an SP value of the binding resin is denoted by δB ((cal/cm$^3$)$^{1/2}$), an SP value of the polar resin H is denoted by δH ((cal/cm$^3$)$^{1/2}$), and an SP value of the polar resin L is denoted by δL ((cal/cm$^3$)$^{1/2}$), the following formulas are satisfied;

$$8.70 \leqq \delta B \leqq 9.50$$

$$1.00 \leqq \delta H - \delta B \leqq 3.00$$

$$|\delta L - \delta B| \leqq 0.70,$$

wherein when a glass transition point of the polar resin H is denoted by TgH (° C.) and a glass transition point of the polar resin L is denoted by TgL (° C.), the following formulas are satisfied;

$$65.0 \leqq TgH \leqq 85.0$$

$$75.0 \leqq TgL \leqq 105.0$$

$$TgH < TgL,$$

wherein when a weight-average molecular weight of the polar resin H is denoted by MwH and a weight-average molecular weight of the polar resin L is denoted by MwL, MwH is $5.0\times10^3$ or more and $1.5\times10^4$ or less, and MwL is $1.0\times10^4$ or more and $3.0\times10^4$ or less, wherein a content of the polar resin H with respect to 100.0 parts by mass of the binding resin is 1.0 part by mass or more and 10.0 parts by mass or less, and a content of the polar resin L with respect to 100.0 parts by mass of the binding resin is 5.0 parts by mass or more and 25.0 parts by mass or less, wherein δH is 10.00 or more and 12.00 or less, and wherein δL is 8.80 or more and 10.00 or less.

2. The toner according to claim 1, wherein when an acid value of the binding resin is denoted by AvB (mgKOH/g), an acid value of the polar resin H is denoted by AvH (mgKOH/g), and an acid value of the polar resin L is denoted by AvL (mgKOH/g), the following formulas are satisfied:

$$0.0 \leqq AvB \leqq 2.0$$

$$5.0 \leqq AvH \leqq 20.0$$

$$8.0 \leqq AvL \leqq 25.0$$

$$AvH < AvL.$$

3. The toner according to claim 1, wherein each of the polar resin H and the polar resin L contains a hydroxyl group, and when a hydroxyl value of the polar resin H is denoted by OHvH (mgKOH/g) and a hydroxyl value of the polar resin L is denoted by OHvL (mgKOH/g), the following formulas are satisfied:

$$15.0 \leqq OHvH \leqq 30.0$$

$$8.0 \leqq OHvL \leqq 25.0.$$

4. The toner according to claim 1, wherein the polar resin L is a vinyl-based resin, and the polar resin H is a polyester-based resin.

5. The toner according to claim 4, wherein a peak molecular weight Mp of the polar resin L is $1.0\times10^4$ or more and $3.0\times10^4$ or less, and when an acid value of a lower molecular weight component, having a molecular weight in a range less than Mp, is denoted by α (mgKOH/g) and an acid value of a higher molecular weight component, having a molecular weight in a range of not less than Mp, is denoted by β (mgKOH/g), $0.8 \leqq \alpha/\beta \leqq 1.2$ is satisfied.

6. The toner according to claim 1, wherein the toner particle contains a polymer or a copolymer having a sulfonic group, a sulfonate group, or a sulfonic ester group.

7. A toner particle producing method of producing a toner particle, the toner particle comprising a binding resin, a colorant, a polar resin H, and a polar resin L, the method comprising the steps of:

adding, to a water-based medium, a polymerizable monomer composition that comprises a polymerizable monomer, the colorant, the polar resin H, and the polar resin L;

granulating the polymerizable monomer composition in the water-based medium to form a particle of the polymerizable monomer composition; and polymerizing the polymerizable monomer in the polymerizable monomer composition, and forming the binding resin, wherein the polar resin H and the polar resin L are each a polar resin containing a carboxyl group and having an acid value of 3.0 (mgKOH/g) or more, wherein when an SP value of the binding resin is denoted by δB ((cal/cm$^3$)$^{1/2}$), an SP value of the polar resin H is denoted by δH ((cal/cm$^3$)$^{1/2}$), and an SP value of the polar resin L is denoted by δL ((cal/cm$^3$)$^{1/2}$), the following formulas are satisfied:

$$8.70 \leqq \delta B \leqq 9.50$$

$$1.00 \leqq \delta H - \delta B \leqq 3.00$$

$$|\delta L - \delta B| \leqq 0.70,$$

wherein when a glass transition point of the polar resin H is denoted by TgH (° C.) and a glass transition point of the polar resin L is denoted by TgL (° C.), the following formulas are satisfied:

$$65.0 \leqq TgH \leqq 85.0$$

$$75.0 \leqq TgL \leqq 105.0$$

$$TgH < TgL,$$

wherein when a weight-average molecular weight of the polar resin H is denoted by MwH and a weight-average molecular weight of the polar resin L is denoted by MwL, MwH is $5.0\times10^3$ or more and $1.5\times10^4$ or less, and MwL is $1.0\times10^4$ or more and $3.0\times10^4$ or less, wherein a content of the polar resin H with respect to 100.0 parts by mass of the binding resin is 1.0 part by mass or more and 10.0 parts by mass or less, and a content of the polar resin L with respect to 100.0 parts by mass of the binding resin is 5.0 parts by mass or more and 25.0 parts by mass or less, wherein δH is 10.00 or more and 12.00 or less, and δL is 8.80 or more and 10.00 or less.

8. The toner particle producing method according to claim 7, further comprising a step of, before adding the polymerizable monomer composition to the water-based medium:

processing the polymerizable monomer composition by using a stirring apparatus, which includes stirring blades rotating at a high speed and a screen disposed around the stirring blades and rotated at a high speed in a direction reversed to a rotating direction of the stirring blades.

9. The toner particle producing method according to claim 7, further comprising a step of, before adding the polymerizable monomer composition to the water-based medium:

processing the polymerizable monomer composition by using a stirring apparatus in which a rotor including ring-like projections, each provided with a plurality of slits, arranged in concentric multiple stages and a stator having a similar shape to that of the rotor are coaxially disposed in an interdigitated relation with a certain gap left therebetween.

* * * * *

UNITED STATES PATENT AND TRADEMARK OFFICE

CERTIFICATE OF CORRECTION

PATENT NO. : 8,518,623 B2
APPLICATION NO. : 13/076265
DATED : August 27, 2013
INVENTOR(S) : Kenta Kamikura et al.

It is certified that error appears in the above-identified patent and that said Letters Patent is hereby corrected as shown below:

On the title page, Item (73), the name of the assignee should be changed from "Canon Kabushiki Kasiha" to --CANON KABUSHIKI KAISHA--.

Signed and Sealed this
Fifth Day of November, 2013

Teresa Stanek Rea
*Deputy Director of the United States Patent and Trademark Office*